US010733834B1

(12) United States Patent
Hiten et al.

(10) Patent No.: US 10,733,834 B1
(45) Date of Patent: Aug. 4, 2020

(54) GAMING SYSTEM AND METHOD OF PROVIDING IMPROVED GAME OUTCOMES

(71) Applicant: ADP GAUSELMANN GMBH, Espelkamp (DE)

(72) Inventors: Charles Hiten, Lighthouse, FL (US); Michael Charles Halvorson, Las Vegas, NV (US); Josef Alexander Hartl, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/264,410

(22) Filed: Jan. 31, 2019

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01); *G07F 17/3288* (2013.01); *G07F 17/3267* (2013.01)

(58) Field of Classification Search
CPC ..... G07F 17/3213; G07F 17/3209; G07F 17/3244; G07F 17/3288; G07F 17/3267
See application file for complete search history.

(56) References Cited

U.S. PATENT DOCUMENTS 5,833,537 A * 11/1998 Barrie ..... G07F 17/3265 463/21
5,980,384 A 11/1999 Barrie
6,159,095 A 12/2000 Frohm et al.
6,186,894 B1 2/2001 Mayeroff
6,251,013 B1 6/2001 Bennett
6,290,600 B1 9/2001 Glasson
6,311,976 B1 11/2001 Yoseloff et al.
6,319,124 B1 11/2001 Baerlocher et al.
6,394,902 B1 5/2002 Glavich et al.
6,517,432 B1 2/2003 Jaffe
6,558,254 B2 5/2003 Baerlocher et al.
6,561,900 B1 5/2003 Baerlocher et al.
6,632,140 B2 10/2003 Berman et al.
6,692,356 B2 2/2004 Baerlocher et al.
6,780,109 B2 8/2004 Kaminkow
6,866,583 B2 3/2005 Glavich et al.
6,896,617 B2 5/2005 Daly
(Continued)

FOREIGN PATENT DOCUMENTS

AU 2014903132 8/2014
AU 2015210489 A1 2/2016
(Continued)

OTHER PUBLICATIONS

Aristocrat Technologies Australia PTY LTD., "Lightning Link", Retrieved from the Internet on Oct. 25, 2018: http://www.aristocrat-us.com/lightning-link, p. 1.

*Primary Examiner* — Corbett B Coburn
(74) *Attorney, Agent, or Firm* — Resolute Legal, PLLC

(57) ABSTRACT

Various embodiments of a gaming system and method are disclosed as enabling improvements to game outcomes. In some embodiments, the gaming system enables the player to adjust game elements to different positions to improve game outcomes. In some embodiments, the gaming system enables the player to move one or more symbols to different symbol positions to improve a game outcome. In some embodiments, the player purchases the opportunity to move one or more symbols to different symbol positions to improve a game outcome.

20 Claims, 25 Drawing Sheets

(56) References Cited

U.S. PATENT DOCUMENTS 6,921,335 B2 7/2005 Rodgers et al.
7,052,395 B2 5/2006 Glavich et al.
7,137,888 B2 11/2006 Glavich et al.
7,384,334 B2 6/2008 Glavich et al.
7,393,277 B2 7/2008 Jackson
7,396,282 B2 7/2008 Gauselmann
7,399,225 B2 7/2008 Kaminkow
7,736,223 B2 6/2010 Pace
7,749,071 B2 7/2010 Marks et al.
7,794,320 B2 9/2010 Baerlocher et al.
7,846,018 B2 12/2010 Baerlocher
7,922,573 B2 4/2011 Baerlocher et al.
7,927,204 B2 4/2011 DeBrabander, Jr. et al.
7,959,504 B2 6/2011 Baumgartner et al.
8,002,626 B2 8/2011 Englman
8,137,180 B2 3/2012 Thomas et al.
8,152,627 B2 4/2012 Berman et al.
8,162,741 B2 4/2012 Wadleigh et al.
8,197,330 B2 6/2012 Englman et al.
8,231,460 B2 7/2012 Gauselmann
8,272,944 B2 9/2012 Englman et al.
8,337,300 B2 12/2012 Bowers et al.
8,357,041 B1 1/2013 Saunders
8,382,571 B2 2/2013 Marks et al.
8,469,793 B2 6/2013 Visser
8,475,259 B2 7/2013 Weber
8,491,375 B2 7/2013 Low
8,506,380 B2 8/2013 Hughes et al.
8,517,814 B2 8/2013 Visser
8,574,061 B2 11/2013 Marks et al.
8,585,485 B2 11/2013 Guinn
8,608,543 B2 12/2013 Cuddy et al.
8,622,809 B1 1/2014 Arora et al.
8,814,658 B2 8/2014 Marks et al.
8,840,457 B1 9/2014 Basallo et al.
9,011,233 B2 4/2015 Ryan
9,129,492 B2 9/2015 Marks et al.
9,153,090 B2 10/2015 Pacey et al.
9,177,448 B2 11/2015 Caputo et al.
9,214,067 B2 12/2015 Basallo et al.
9,218,705 B2 12/2015 Taylor
9,230,409 B2 1/2016 Pawloski
9,449,470 B2 9/2016 Baerlocher et al.
9,460,687 B2 10/2016 Chiu et al.
9,704,342 B2 7/2017 Aoki et al.
9,710,998 B2 7/2017 Nelson et al.
9,786,116 B2 10/2017 Saunders
9,805,542 B2 10/2017 Rodgers et al.
9,805,553 B2 10/2017 Zielinski et al.
9,852,574 B2 12/2017 Zoltewicz et al.
9,928,691 B2 3/2018 Olive
10,037,651 B2 7/2018 You et al.
2001/0054794 A1 12/2001 Cole et al.
2002/0043759 A1 4/2002 Vancura
2002/0045474 A1 4/2002 Singer et al.
2003/0022712 A1 1/2003 Locke
2004/0009808 A1 1/2004 Gauselmann
2004/0043809 A1 3/2004 Gomez et al.
2004/0048646 A1 3/2004 Visocnik
2004/0053673 A1 3/2004 Mishra
2004/0204228 A1 10/2004 Walker et al.
2005/0130737 A1 6/2005 Englman et al.
2005/0159208 A1 7/2005 Pacey
2006/0058097 A1 3/2006 Berman et al.
2006/0068892 A1 3/2006 Gomez et al.
2006/0154717 A1 7/2006 Jackson
2006/0189377 A1 8/2006 Gomez et al.
2008/0045302 A1 2/2008 Low
2008/0248865 A1 10/2008 Tedesco et al.
2009/0131150 A1 5/2009 Iverson et al.
2009/0137311 A1 5/2009 Iverson et al.
2009/0221353 A1 9/2009 Joung
2010/0029381 A1 2/2010 Vancura
2010/0120489 A1 5/2010 Meyer
2010/0190542 A1* 7/2010 Mizue ..... G07F 17/34 463/20
2010/0197377 A1* 8/2010 Aoki ..... G07F 17/32 463/20
2010/0304833 A1 12/2010 Berman
2011/0003627 A1 1/2011 Nicely et al.
2011/0034234 A1 2/2011 Berman et al.
2011/0111829 A1 5/2011 Joung
2011/0117989 A1* 5/2011 Kennedy ..... G07F 17/34 463/20
2011/0136565 A1 6/2011 Low
2011/0230251 A1 9/2011 Nicely et al.
2012/0231868 A1 9/2012 Guinn
2012/0292588 A1 11/2012 Watkins et al.
2013/0143639 A1 6/2013 Nakamura
2014/0018146 A1 1/2014 Zielinski et al.
2014/0039693 A1 2/2014 Lanning et al.
2014/0087821 A1 3/2014 Zoltewicz et al.
2014/0087860 A1 3/2014 Basallo et al.
2014/0087861 A1 3/2014 Basallo et al.
2014/0274294 A1 9/2014 Baerlocher et al.
2014/0309010 A1 10/2014 Pawloski
2014/0357342 A1 12/2014 Elias
2015/0080096 A1 3/2015 Saunders et al.
2015/0141114 A1 5/2015 Davis et al.
2015/0248810 A1* 9/2015 Wortmann ..... G07F 17/32 463/20
2015/0287269 A1 10/2015 Berman
2015/0310699 A1 10/2015 Meyer
2015/0348374 A1 12/2015 Dupuis
2016/0042597 A1 2/2016 Olive
2016/0078711 A1 3/2016 Rucker
2016/0086429 A1 3/2016 Inamura et al.
2016/0253873 A1 9/2016 Olive
2016/0335842 A1 11/2016 Zoble et al.
2017/0032610 A1 2/2017 Loz et al.
2017/0092067 A1 3/2017 Batsiokis
2017/0124809 A1 5/2017 Elias
2017/0154498 A1 6/2017 Olive
2018/0082535 A1 3/2018 Filipour et al.
2018/0082546 A1* 3/2018 Mariscal ..... G07F 17/34
2018/0122183 A1 5/2018 Wortmann
2018/0130298 A1 5/2018 Koshorek
2018/0218572 A1 8/2018 Caputo
2018/0225914 A1 8/2018 Heenan et al.
2018/0261045 A1 9/2018 Takahara et al.
2018/0268655 A1 9/2018 Olive
2018/0268657 A1 9/2018 Kroon
2018/0286183 A1 10/2018 Davis et al.
2019/0019371 A1 1/2019 Bolling, Jr.

FOREIGN PATENT DOCUMENTS

AU 2016900462 2/2016
AU 2016100230 A4 3/2016
AU 2016202727 A1 5/2016
AU 2016101967 A4 12/2016
AU 2017200840 A1 3/2017
AU 2017204560 A1 7/2017
AU 2017101097 A4 9/2017
AU 2017101098 A4 9/2017
AU 2017101629 A4 12/2017
AU 2017101730 A4 1/2018
AU 2017101731 A4 1/2018
AU 2018278882 A1 1/2019
AU 2019200719 A1 2/2019

* cited by examiner

GAMING SYSTEM AND METHOD OF PROVIDING IMPROVED GAME OUTCOMES

FIELD OF THE INVENTION

The present disclosure relates to gaming devices.

SUMMARY OF THE INVENTION

Various embodiments of a gaming system and method are disclosed as enabling improvements to game outcomes. In some embodiments, the gaming system enables the player to adjust game elements to different positions to improve game outcomes. In some embodiments, the gaming system enables the player to move one or more symbols to different symbol positions to improve a game outcome. In some embodiments, the gaming system enables the player to reposition a prior selection in a selection game to improve a game outcome. In some embodiments, the player purchases the opportunities to improve a game outcome.

In a game with outcome improvements, a player may obtain an outcome that almost equates to a winning outcome. For example, the player may almost obtain all of the symbols necessary to obtain a winning outcome along a pay line in a slot reel game. However, the player may miss obtaining one of the necessary symbols on one slot reel along the pay line for a winning symbol combination. The missing necessary symbol may be located on an adjacent slot reel just above the pay line (e.g., one symbol display position above the almost winning pay line). Thus, the player would have obtained a winning outcome if the missing necessary symbol on the one slot reel had advanced by one symbol display position to the almost winning pay line. Such an outcome can be extremely disappointing to a player and cause players to avoid playing games. To mitigate the player's disappointment, in some embodiments, the gaming system enables the player to move symbols in certain game conditions to one or more winning symbol display positions to improve game outcomes. In some embodiments, the improvements to game outcomes may improve existing winning game outcomes.

In various embodiments, the gaming system enables the player to move game elements to different positions to improve game outcomes in bonus games. In alternative embodiments, the gaming system enables the player to move game elements to different positions to improve game outcomes in base games.

In one embodiment with game element adjustments, a gaming system includes a plurality of symbol display areas associated with a plurality of video based slot machine reels. For example, the gaming system may include five video based slot machine reels that are each associated with three symbol display areas. The gaming system further includes a symbol set that includes a plurality of symbols associated with each slot machine reel. For a play of a game, for each slot machine reel, the gaming system generates a plurality of symbols from the associated symbol sets for the symbol display areas of the reel. The gaming system evaluates the generated plurality of symbols for winning symbol combinations. The gaming system determines a payout amount based on winning symbol combinations along wagered pay lines. The gaming system also evaluates the generated plurality of symbols for triggering symbol combinations along a wagered pay line. If the gaming system determines that a triggering symbol combination was generated along a wagered pay line, the gaming system activates a bonus game and awards a predetermined quantity of free spins for the bonus game.

In some embodiments, the gaming system alters the play of the game during the bonus game. In some embodiments, the gaming system designates at least one symbol in each of the symbol sets as a persistent symbol during the bonus game. If the gaming system generates and displays a persistent symbol in a particular symbol display area on a reel in any particular free spin activation, the gaming system keeps the persistent symbol in the displayed symbol position for the duration of the remaining free spins. In one embodiment, the gaming system changes the pay table. In one embodiment, the persistent symbol is associated with a plurality of different values disassociated from symbol combinations along a wagered pay line. In some embodiments, the gaming system randomly assigns one of the plurality of different values to a persistent symbol before, during, or after when the persistent symbol is generated and displayed in a particular symbol display area. In some embodiments, the gaming system randomly assigns the persistent symbol values to symbol display areas such that a persistent symbol is assigned its value if the gaming system generates and displays a persistent symbol in a particular symbol display area. In some embodiments, the persistent symbol values are awarded if two or more persistent symbols are generated and displayed directly adjacent to each other in the symbol display areas on the reels. That is, to obtain the persistent symbol values as awards, a first persistent symbol must touch a second persistent symbol in a symbol display area that is directly above, directly to the left, directly to the right, or directly below the first persistent symbol to create a persistent symbol group. In some embodiments, the gaming system does not award a value associated with a persistent symbol when the persistent symbol is not touching at least one other persistent symbol in a symbol display area that is directly above, directly to the left, directly to the right, or directly below the first persistent symbol. In some embodiments, a predetermined quantity of persistent symbols must be in a persistent symbol group before the gaming system awards the values associated with the persistent symbols in the persistent symbol group. In some such embodiments, the pay table for the bonus game reduces or eliminates other symbol combinations that results in awards.

In some embodiments, the gaming system may generate persistent symbols that are not touching other persistent symbols (e.g., standalone persistent symbols) during the free spins. In some embodiments, these standalone persistent symbols are close to (e.g., one or more symbol display positions away from) a persistent symbol group, which does not result in a winning outcome associated with the standalone persistent symbols. That is, player would have obtained the additional value associated with the standalone persistent symbol if the gaming system generated the standalone persistent symbol closer to the persistent symbol group. When standalone persistent symbols are generated, the gaming system may offer the player the ability to move or shift the position of at least one of any standalone persistent symbols and attempt to connect the at least one standalone persistent symbol to the persistent symbol group. In one embodiment, the gaming system may offer the player the ability to purchase a persistent symbol movement. The persistent symbol movement enables the player to selectively move the standalone persistent symbol one or more symbol display positions along the same reel or across reels and connect the standalone persistent symbol to the persistent symbol group. Different purchase levels may unlock the ability to move a standalone persistent symbol across more symbol display positions. Thus, it should be appreciated that the persistent symbol movement enables the player to unlock and obtain a value associated with a previously standalone persistent symbol and improve the player's award. Once a standalone persistent symbol is connected to a persistent symbol group, the gaming system awards the value associated with the previously standalone persistent symbol, which may improve the player's award. Such a movement of the game element (e.g., the standalone persistent symbol) mitigates the player's disappointment at a losing outcome (e.g., not winning an enhanced prize associated with the standalone persistent symbol) and may increase the player's awarded prize value.

In some embodiments, the player's selected move location (e.g., symbol display position) may alter the available award improvement. In some embodiments, the player can choose one or more locations to move the persistent symbol to, for an award enhancement. In some embodiments, the different available spaces may result in different award enhancements. In some such embodiments, a first available symbol display area to receive the standalone persistent symbol may be associated with a higher value than a second available symbol display area to receive the standalone persistent symbol. The player may not be told which of the first or second available symbol display areas provide a greater award value. The gaming system may offer the player a chance to purchase a persistent symbol movement (or obtain the movement without any purchase) at the start of the play of the game, during the play of the game (including during the bonus game), or after all of the free spins have been used during a play of the bonus game and one or more standalone persistent symbols are displayed.

By enabling the player to turn losing outcomes into award enhancements and providing players with some control over an outcome, the gaming system reduces player disappointment with game outcomes and enhances player excitement for a game. The new potential to improve or earn greater awards creates a greatly improved sense of anticipation for players.

DETAILED DESCRIPTION OF THE INVENTION

Figure 1:
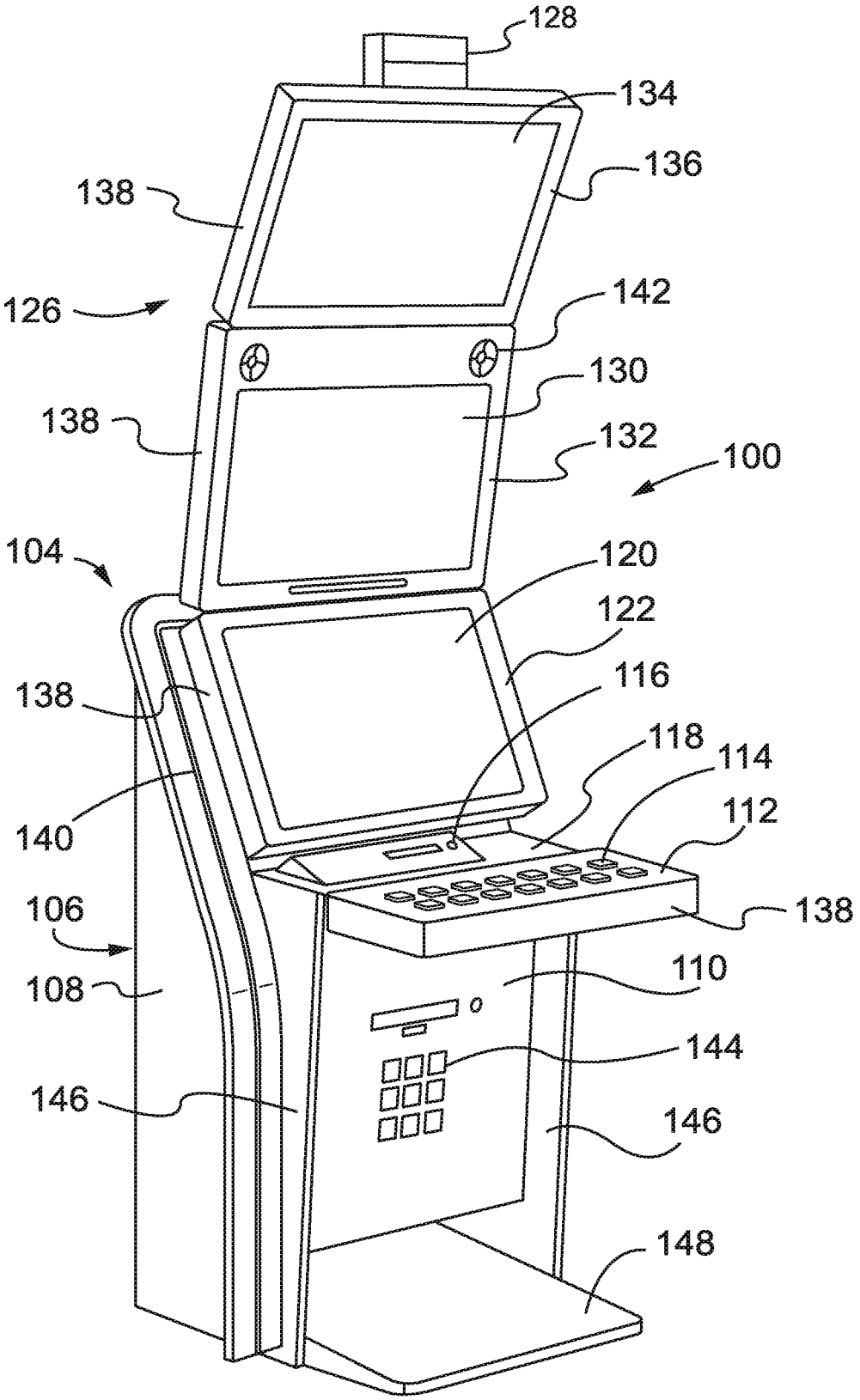
FIG. 1 is a perspective view of one embodiment of a stand-alone gaming device of a gaming system.

Various embodiments of a gaming system and method are disclosed as enabling improvements to game outcomes. In some embodiments, the gaming system enables the player to adjust game elements to different positions to improve game outcomes. In some embodiments, the gaming system enables the player to move one or more symbols to different symbol positions to improve a game outcome. In some embodiments, the gaming system enables the player to reposition a prior selection in a selection game to improve a game outcome. In some embodiments, the player purchases the opportunities to improve a game outcome.

In various embodiments, the gaming system enables the player to move game elements to different positions to improve game outcomes in base games, bonus games, or both.

In one embodiment with game element adjustments, a gaming system includes a plurality of symbol display areas associated with a plurality of video based slot machine reels. For example, the gaming system may include five video based slot machine reels that are each associated with three symbol display areas. The gaming system further includes a symbol set that includes a plurality of symbols associated with each slot machine reel. For a play of a game, for each slot machine reel, the gaming system generates a plurality of symbols from the associated symbol sets for the symbol display areas of the reel. The gaming system evaluates the generated plurality of symbols for winning symbol combinations. The gaming system determines a payout amount based on winning symbol combinations along wagered pay lines. The gaming system also evaluates the generated plurality of symbols for triggering symbol combinations along a wagered pay line. If the gaming system determines that a triggering symbol combination was generated along a wagered pay line, the gaming system activates a bonus game and awards a predetermined quantity of free spins for the bonus game.

In some embodiments, the gaming system alters the play of the game during the bonus game. In some embodiments, the gaming system designates at least one symbol in each of the symbol sets as a persistent symbol during the bonus game. If the gaming system generates and displays a persistent symbol in a particular symbol display area on a reel in any particular free spin activation, the gaming system keeps the persistent symbol in the displayed symbol position for the duration of the remaining free spins. In one embodiment, the gaming system changes the pay table. In one embodiment, the persistent symbol is associated with a plurality of different values disassociated from symbol combinations along a wagered pay line. In some embodiments, the gaming system randomly assigns one of the plurality of different values to a persistent symbol before, during, or after when the persistent symbol is generated and displayed in a particular symbol display area. In some embodiments, the gaming system randomly assigns the persistent symbol values to symbol display areas such that a persistent symbol is assigned its value if the gaming system generates and displays a persistent symbol in a particular symbol display area. In some embodiments, the persistent symbol values are awarded if two or more persistent symbols are generated and displayed directly adjacent to each other in the symbol display areas on the reels. That is, to obtain the persistent symbol values as awards, a first persistent symbol must touch a second persistent symbol in a symbol display area that is directly above, directly to the left, directly to the right, or directly below the first persistent symbol to create a persistent symbol group. In some embodiments, the gaming system does not award a value associated with a persistent symbol when the persistent symbol is not touching at least one other persistent symbol in a symbol display area that is directly above, directly to the left, directly to the right, or directly below the first persistent symbol. In some embodiments, a predetermined quantity of persistent symbols must be in a persistent symbol group before the gaming system awards the values associated with the persistent symbols in the persistent symbol group. In some such embodiments, the pay table for the bonus game reduces or eliminates other symbol combinations that results in awards.

In some embodiments, the gaming system may generate persistent symbols that are not touching other persistent symbols (e.g., standalone persistent symbols) during the free spins. In some embodiments, these standalone persistent symbols are close to (e.g., one or more symbol display positions away from) a persistent symbol group, which does not result in a winning outcome associated with the standalone persistent symbols for the player. That is, player would have obtained the additional value associated with the standalone persistent symbol if the gaming system generated the standalone persistent symbol closer to the persistent symbol group. When standalone persistent symbols are generated, the gaming system may offer the player the ability to move or shift the position of at least one of any standalone persistent symbols and attempt to connect the at least one standalone persistent symbol to the persistent symbol group. In one embodiment, the gaming system may offer the player the ability to purchase a persistent symbol movement. The persistent symbol movement enables the player to selectively move the standalone persistent symbol one or more symbol display positions along the same reel or across reels and connect the standalone persistent symbol to the persistent symbol group. Different purchase levels may unlock the ability to move a standalone persistent symbol across more symbol display positions. Thus, it should be appreciated that the persistent symbol movement enables the player to unlock and obtain a value associated with a previously standalone persistent symbol and improve the player's award. Once a standalone persistent symbol is connected to a persistent symbol group, the gaming system awards the value associated with the previously standalone persistent symbol, which may improve the player's award. Such a movement of the game element (e.g., the standalone persistent symbol) mitigates the player's disappointment at a losing outcome (e.g., not winning an enhanced prize associated with the standalone persistent symbol) and may increase the player's awarded prize value.

In some embodiments, the player's selected move location (e.g., symbol display position) may alter the available award improvement. In some embodiments, the player can choose one or more locations to move the persistent symbol to, for an award enhancement. In some embodiments, the different available spaces may result in different award enhancements. In some such embodiments, a first available symbol display area to receive the standalone persistent symbol may be associated with a higher value than a second available symbol display area to receive the standalone persistent symbol. The player may not be told which of the first or second available symbol display areas provide a greater award value. The gaming system may offer the player a chance to purchase a persistent symbol movement (or obtain the movement without any purchase) at the start of the play of the game, during the play of the game (including during the bonus game), or after all of the free spins have been used during a play of the bonus game and one or more standalone persistent symbols are displayed.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
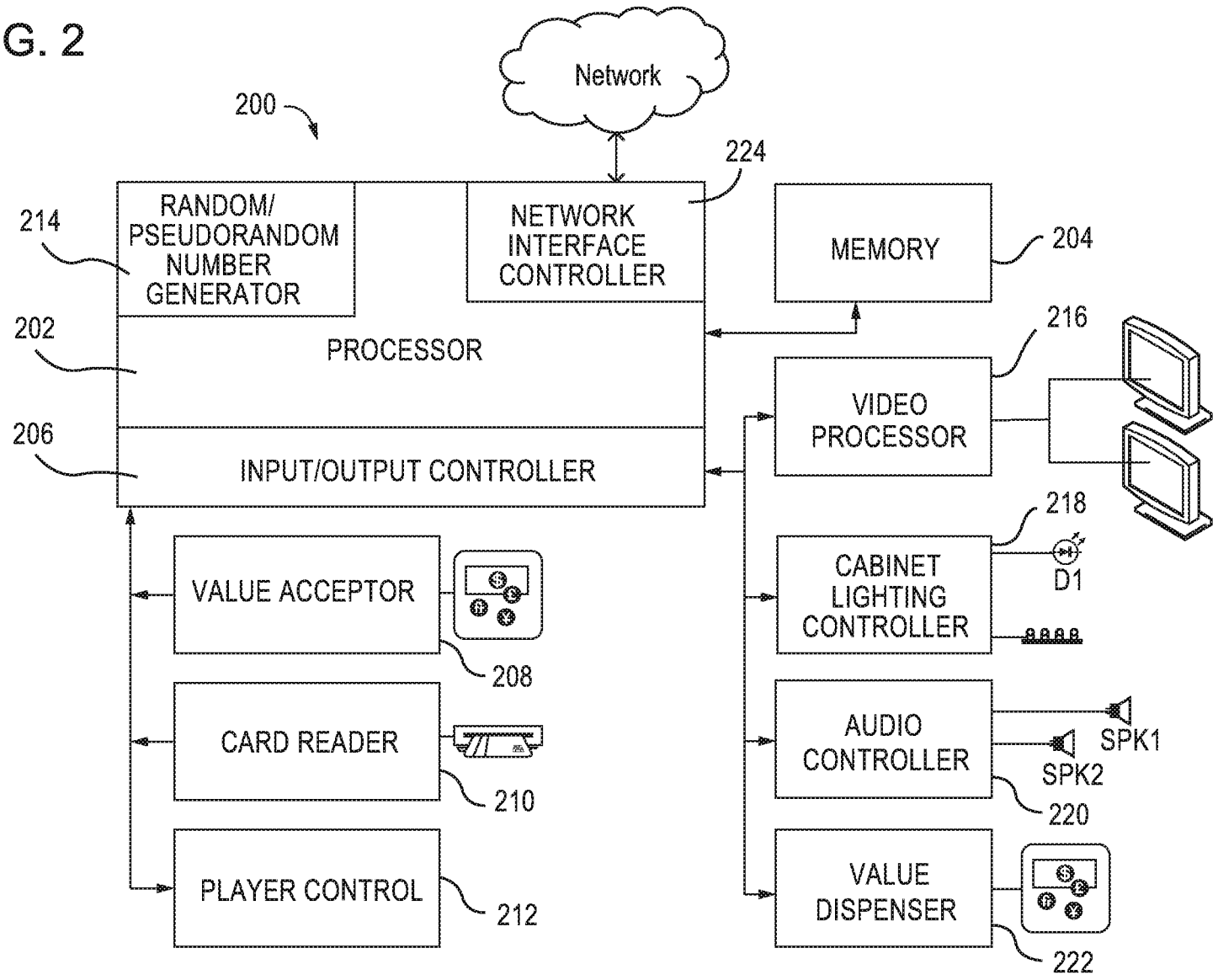
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
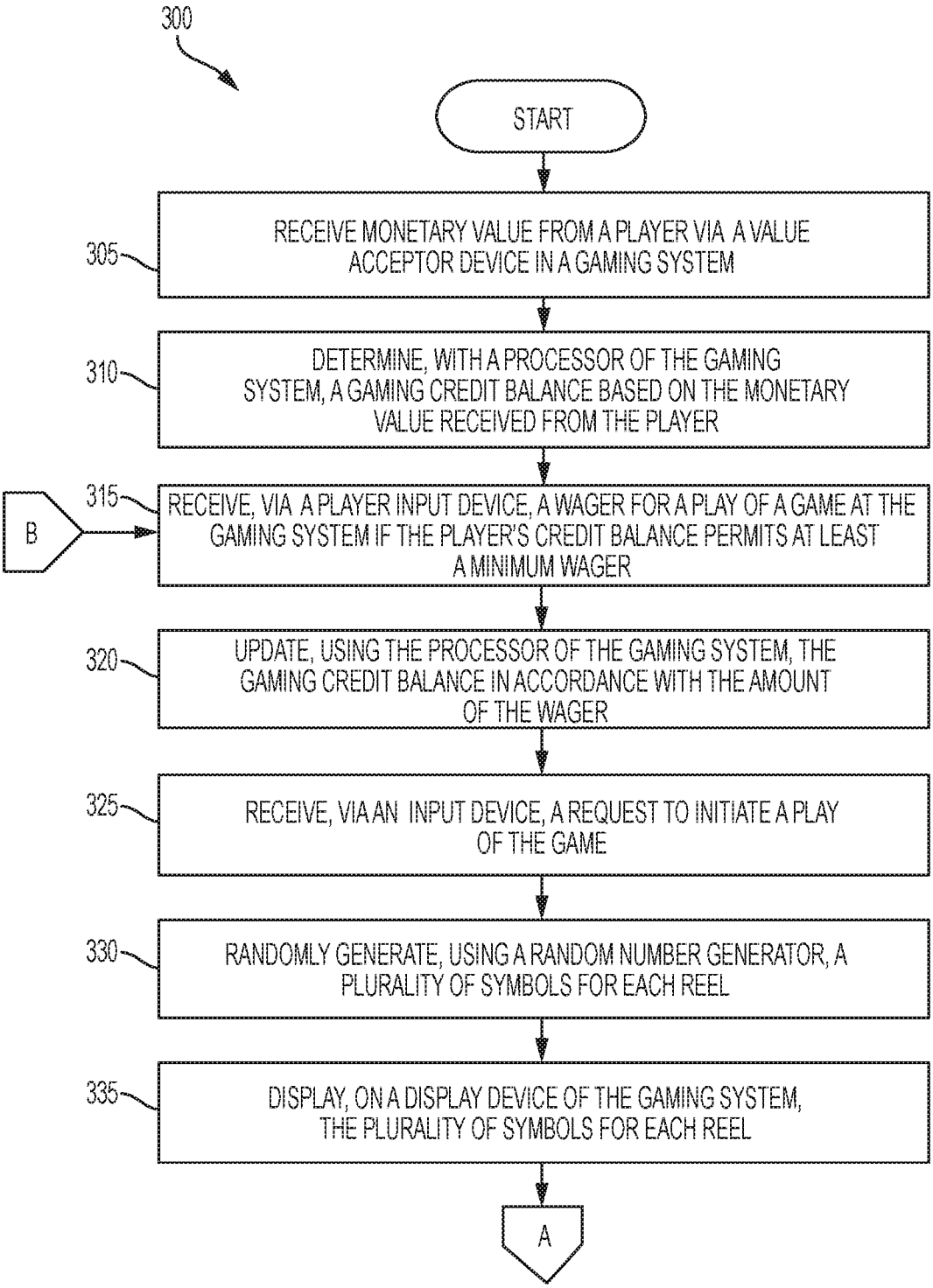
FIGS. 3A, 3B, 3C, and 3D illustrate one embodiment of a method of operating the gaming system having improvements to game outcomes.
Figure 3B:
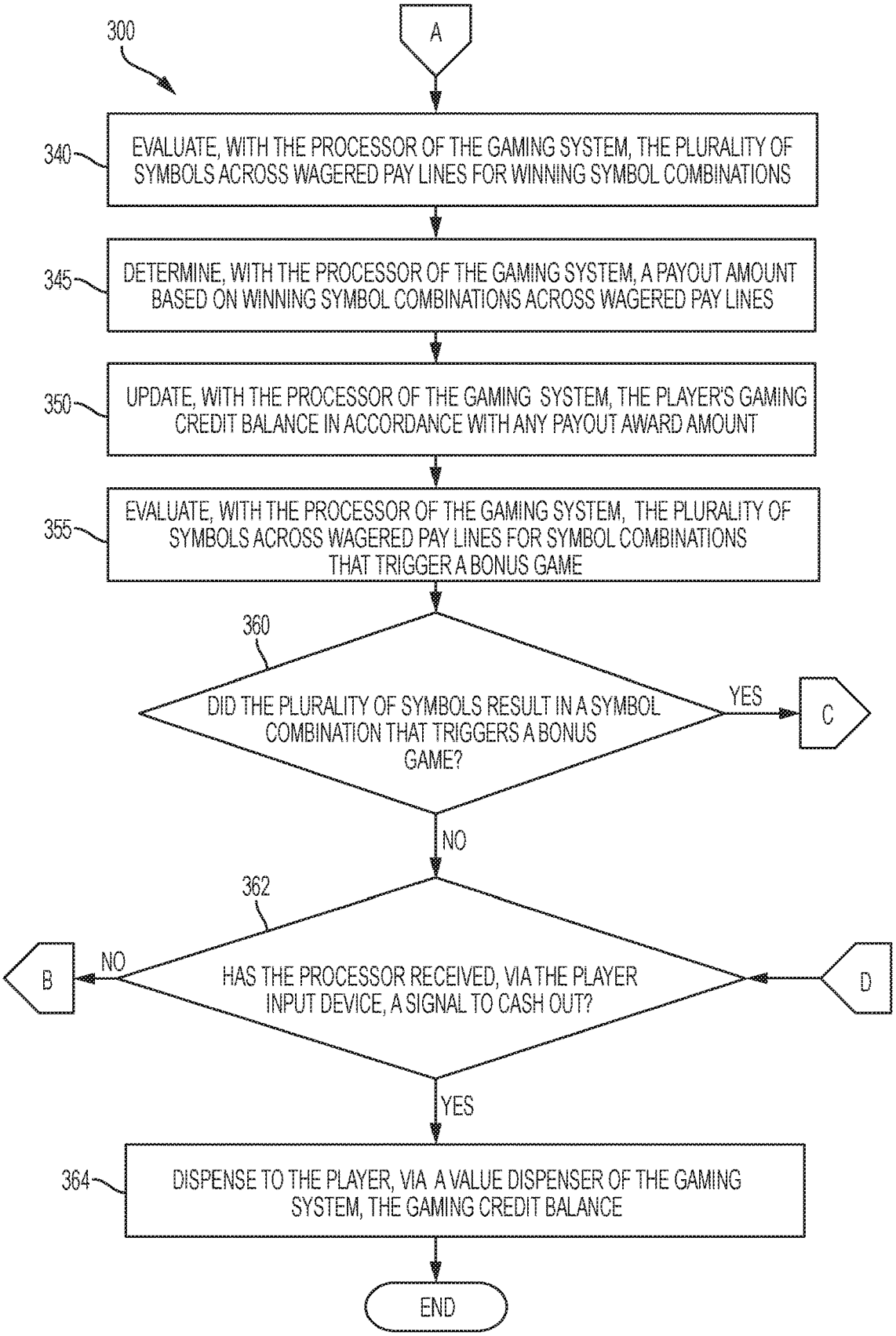
Figure 3C:
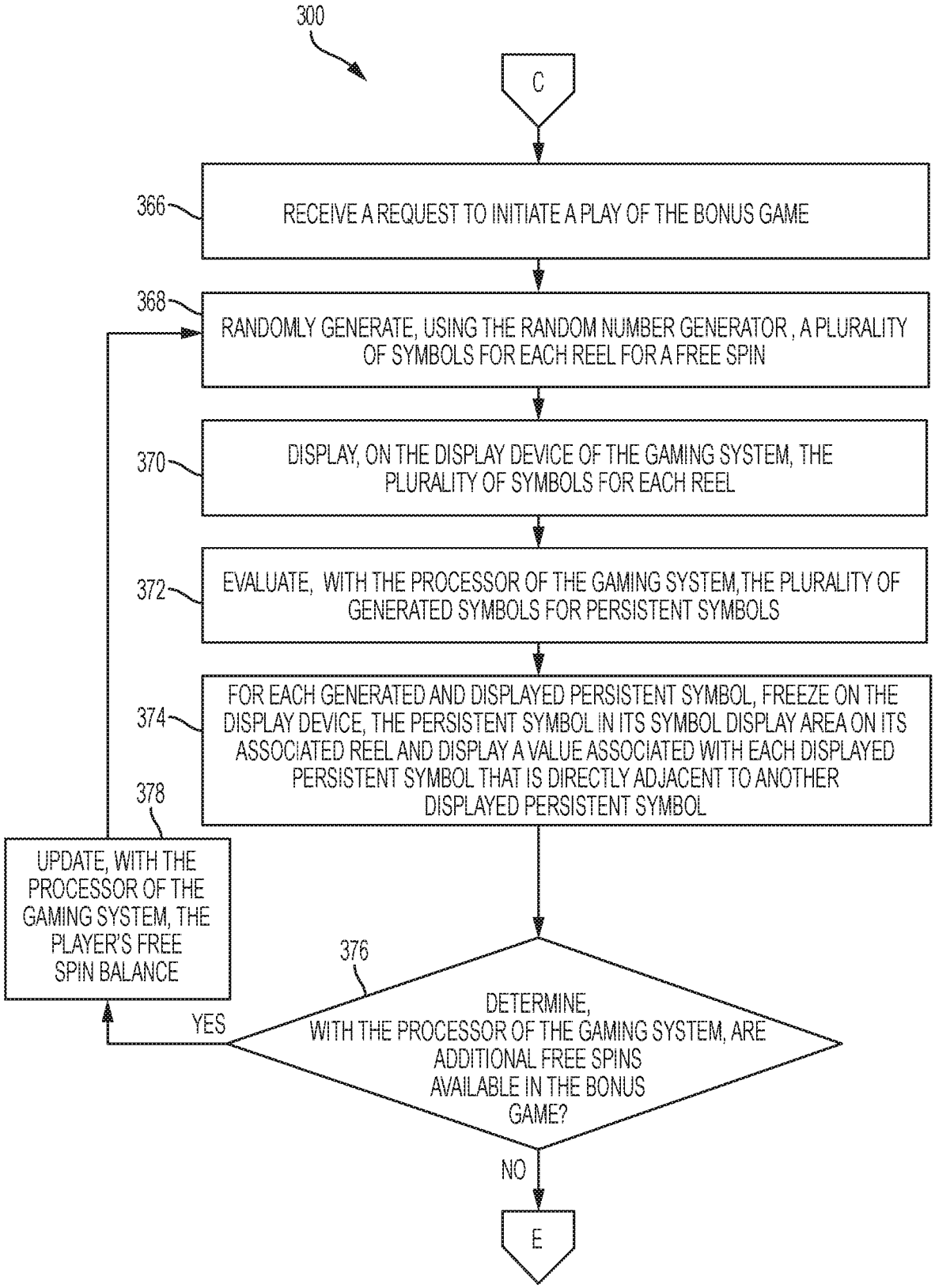
Figure 3D:
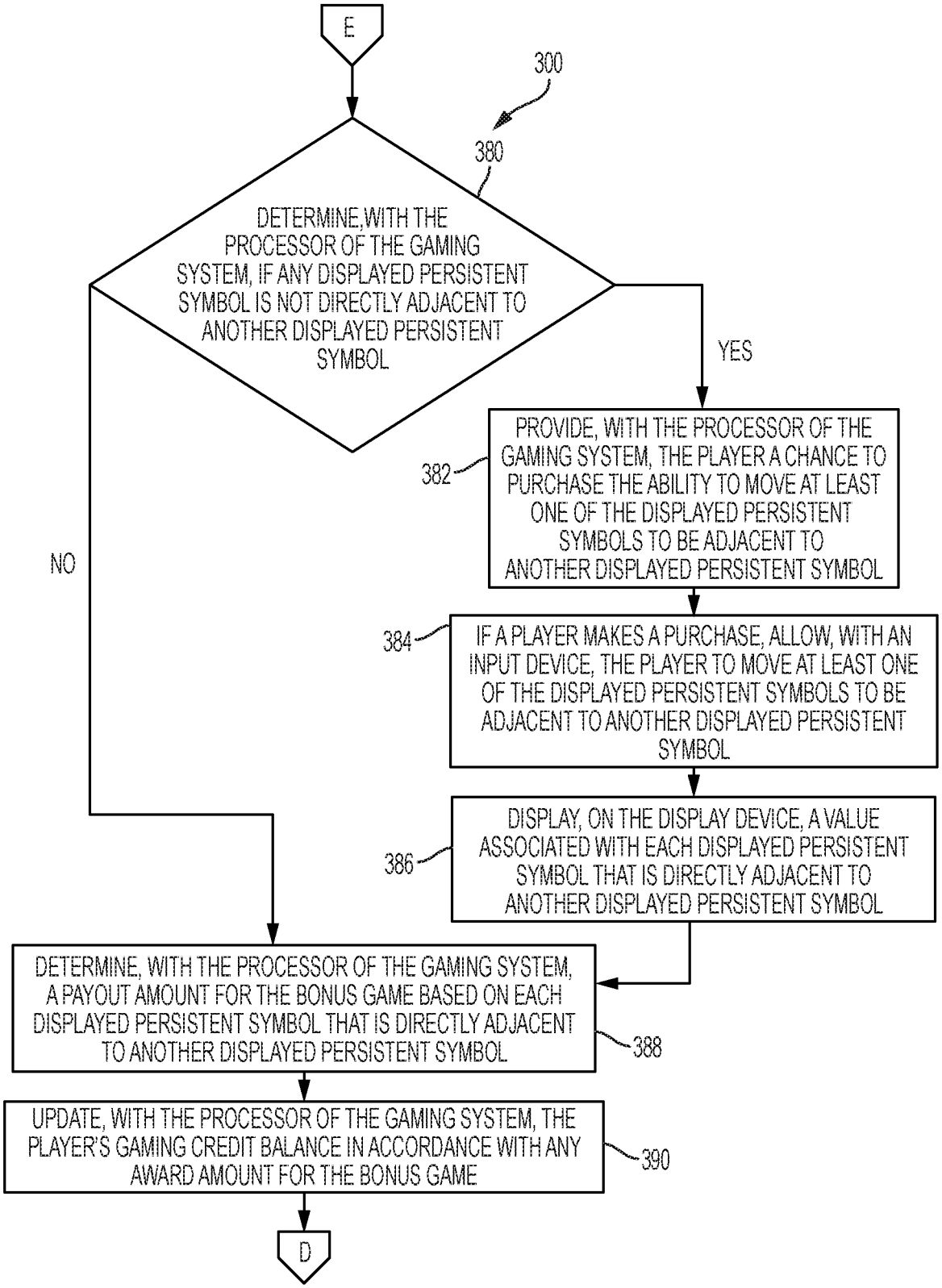

FIGS. 3A, 3B, 3C, and 3D illustrate a flowchart of an example operation 300 of one embodiment of the gaming system and method. FIGS. 3A and 3B are depicted as a base or primary game while FIGS. 3C and 3D are depicted as a bonus game. However, it should be appreciated that FIGS. 3C and 3D may be integrated as part of a base game without entering a separate bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols from a plurality of sets of symbols as indicated in block 330. In some embodiments, the gaming system may generate the plurality of symbols for display on a set of reels (or virtual reels). In some such embodiments, each reel is associated with its own set of symbols. As used herein, the random number generation may refer to pseudo-random or true-random number generation depending on the module used for the random number generation.

In one embodiment, the gaming system may cause a display device to display the plurality of symbols generated as indicated in block 335. In a game using reels, the gaming system may display the generated plurality of symbols in visible symbol display areas of each of the reels. Off page connector A refers to FIG. 3B to continue operation 300.

Turning now to FIG. 3B and off page connector A, in one embodiment as shown in block 340, the gaming system evaluates the generated plurality of symbols across active or wagered pay lines for winning symbol combinations. In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated plurality of symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In block 345, the gaming system determines, with the processor, a payout amount based on the evaluated winning symbol combinations across wagered pay lines. As illustrated in block 350, the gaming system may update, with the processor, the player's gaming credit balance in accordance with any award amount. As noted above, the blocks illustrated in FIGS. 3A-3D can be rearranged in any suitable order. As such, it should be appreciated that the gaming system may update player's gaming credit balance at other suitable times.

In one embodiment, as indicated in block 355, the gaming system evaluates the plurality of symbols across wagered pay lines for symbol combinations that trigger a bonus game with free spins. It should also be appreciated that in some embodiments, events other than generating one or more of a predetermined symbol may trigger the bonus game. If the gaming system determined that the generated plurality of symbols did not result in triggering a bonus game, in block 360, operation 300 moves to block 362. In one embodiment, as indicated in block 362, the gaming system may receive a signal to end game play or "cash out" via an input device of the gaming system. In such a situation, the gaming system dispenses a value to the player, through a value dispenser, based on the player's gaming credit balance as illustrated in block 364 and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

Returning now to block 360, if the gaming system determined that the generated plurality of symbols resulted in trigging a bonus game, operation 300 moves to block 366 in FIG. 3C via off page connector C. In one embodiment, if the gaming system determines that the generated plurality of symbols includes one or more generated predetermined symbols, the gaming system will trigger or activate the bonus game. In one embodiment, the predetermined symbol is a symbol that serves one function: to trigger the bonus game. In alternative embodiments, the predetermined symbol serves a plurality of game functions, such as triggering the bonus game and providing an award value. Other suitable game functions may be associated with the predetermined symbol.

In some embodiments, the gaming system alters the play of the game during the bonus game. In some embodiments, the gaming system may change how symbols operate. In some embodiments, the gaming system may use different pay tables in the bonus game to calculate winning symbol combinations. In some embodiments where a symbol operation is altered, the gaming system designates at least one symbol in each of the symbol sets as a persistent symbol (as referred to herein as a freeze symbol or frozen symbol) during the bonus game. In some embodiments, the persistent symbol is the same symbol as the predetermined symbol to trigger a bonus game. In other embodiments, the persistent symbol is different from the predetermined symbol to trigger a bonus game. If the gaming system generates and displays a freeze symbol in a particular symbol display area on a reel in any free spin activation, the gaming system keeps the freeze symbol in the displayed symbol position for the duration of the remaining free spins. Thus, in one such embodiment, a freeze symbol generated and displayed in a symbol display position during a first free spin of the bonus game will remain displayed in that same symbol display position for the duration of the bonus game.

In one embodiment, the gaming system changes the pay table for the bonus game. In one embodiment, the altered pay table removes the need for a predetermined quantity of freeze symbols to be generated along a pay line to result in a winning symbol combination. In one embodiment, the freeze symbol can be associated with a plurality of different values without regard to a wagered pay line. In some embodiments, the gaming system randomly assigns one of the plurality of different values to a freeze symbol before, during, or after a freeze symbol is generated and displayed in a particular symbol display area. In some embodiments, the gaming system randomly determines and assigns one of the plurality of different values to one or more symbol display areas such that when the gaming system generates a freeze symbol in a particular symbol display area, gaming system also assigns the value to that displayed freeze symbol. In some embodiments, the freeze symbol values are awarded if two or more freeze symbols are generated and displayed directly adjacent to each other in the symbol display positions on the reels. That is, to obtain the freeze symbol values as awards, a first freeze symbol must touch at least one other freeze symbol in a symbol display area that is directly above, directly to the left, directly to the right, or directly below the first freeze symbol to create a freeze symbol group. In some embodiments, the gaming system does not award a value associated with a freeze symbol when the freeze symbol is not touching at least one other freeze symbol in a symbol display area that is directly above, directly to the left, directly to the right, or directly below the first freeze symbol. In some embodiments, a predetermined quantity of freeze symbols must be in a freeze symbol group before the gaming system awards the values associated with the freeze symbols in the freeze symbol group. In some such embodiments, the pay table for the bonus game reduces or eliminates other symbol combinations that results in awards. Thus, in some embodiments, the gaming system awards the value associated with freeze symbols in freeze symbol groups, but not for other symbol combinations.

Block 366 of FIG. 3C illustrates one embodiment in which the gaming system may receive a request to initiate a play of the bonus game. As noted above, the features discussed in connection FIG. 3C may also be applied to primary games or games that are not bonus games. The request to initiate the play of the bonus game may be received from a player via a player input device in communication with the gaming system. For example, the player may press a spin button on the gaming system to start randomly generating symbols for the play of the bonus game. In an alternative embodiment, the processor of the gaming system may automatically initiate the play of the bonus game and randomly generate symbols for the play of the game.

In one embodiment, the gaming system uses a random number generator to randomly generate a plurality of symbols from one or more bonus symbol sets for the bonus game as indicated in block 368, for a free spin. For embodiments without a bonus game, the gaming system randomly generates the plurality of symbols from one or more second symbol sets. In some embodiments, the bonus symbol sets comprise one or more symbols that are different from the symbols from the primary game's symbol sets. In some embodiments, the bonus symbol sets comprise the same symbols from the primary game's symbol sets.

In one embodiment, the gaming system may cause a display device to display the plurality of symbols generated as indicated in block 370. In a game using reels, the gaming system may display the generated plurality of symbols in visible symbol display areas of each of the reels.

The gaming system evaluates, with the processor of the gaming system, the generated plurality of symbols for persistent symbols (or freeze symbols) as indicated in block 372. For each generated freeze symbol, the gaming system will hold or maintain the freeze symbol on the display as indicated in block 374. In some embodiments, the gaming system continues to display the freeze symbol in its generated symbol display area for the remainder of the bonus game (e.g., until no free spins remain). In some embodiments, when a freeze symbol is generated and displayed, a value is displayed with the freeze symbol. In other embodiments, when a freeze symbol is generated and displayed, no value is displayed in association with the freeze symbol unless the freeze symbol is generated and displayed directly adjacent to another generated and displayed freeze symbol as indicated in block 374. The value for the freeze symbol may be generated and assigned to the generated and displayed freeze symbols at different times as previously discussed.

In block 376, the gaming system determines, with the processor of the gaming system, whether additional free spins are available for the bonus game. The gaming system may check a free spin counter in its memory for remaining free spins. If additional free spins remain, the gaming system updates, with a processor, the player's free spin balance as indicated in block 378. Process 300 returns to block 368, where the gaming system, using the random number generator, randomly generates a plurality of symbols from one or more bonus symbol sets for the bonus game as indicated in block 368, for a free spin. The 300 continues to loop through blocks 368-378 until no free spins remain.

In some embodiments where the bonus game is a reel game, when a freeze symbol is generated and persistently displayed in a symbol display area during a previous free spin of the bonus game, such previously generated freeze symbol does not interfere with symbols being displayed spinning on the reels. In one embodiment, for subsequent free spins during the bonus game, when the reels are spinning, the symbols on the reels are displayed behind any previously generated and displayed freeze symbols. When the reels stop (when the gaming system generates symbols for the reels for the free spin), the gaming system may evaluate all of the generated symbols for freeze symbols. In some embodiments, the gaming system saves memory and processing power by limiting the evaluation of the currently generated symbols for freeze symbols to symbol display areas that did not already obtain a freeze symbol during the bonus game. As additional free spins are processed, the gaming system will continue to reduce the quantity of symbol display areas requiring evaluation as freeze symbols are generated during different and subsequent free spins of a bonus game. In some embodiments, when a freeze symbol is generated and displayed in symbol display position, the gaming system does not replace the freeze symbol with new freeze symbols. In alternative embodiments, when a freeze symbol is generated and displayed in symbol display position that already has a freeze symbol, the gaming system may replace the existing freeze symbol. In some embodiments, the preexisting freeze symbol is replaced only if the new freeze symbol improves the player's award outcome (e.g., a higher value is associated with the new replacement freeze symbol).

If additional free spins are not available, the process of operation 300 continues to block 380 via off page connector E in FIG. 3D. It should also be appreciated that in some embodiments, the process of operation 300 may continue to block 380 before all of the free spins have been exhausted during the bonus game. In block 380, the gaming system determines with the processor, if any displayed freeze symbol is not directly adjacent to another displayed freeze symbols. If the gaming system determines that at least one displayed freeze symbol is not directly adjacent to another freeze symbol (a standalone freeze symbol), the gaming system provides the player a chance to purchase (place a wager or place a move wager on) the ability to move at least one displayed freeze symbol to another symbol display position as indicated in block 382 (e.g., moving the standalone freeze symbol to be directly adjacent to another freeze symbol). The purchase is a wager that the player can move the standalone freeze symbol and improve the player's bonus game award. In some embodiments, the gaming system provides the player a chance to move a displayed freeze symbol without requiring the user to place a wager (or purchase the move). In some such embodiments, the chance to move is funded by the gaming system operator or by other suitable funding sources. In some such embodiments, if the gaming system generates a predetermined symbol or combination of symbols, the gaming system offers the player a chance to move a displayed freeze symbol without requiring any funding.

In some embodiments, the player can purchase one or more moves. In one embodiment, if the player purchases multiple moves, the player can move a standalone freeze symbol across multiple symbol display areas (e.g., where another freeze symbol is located more than one symbol display area away from the standalone freeze symbol). In an alternative embodiment, if the player purchases multiple moves, the gaming system limits the player to one move at a time. For example, if the player purchases two moves, the gaming system enables the player to move a standalone freeze symbol to one adjacent symbol display area. If the first move does not result in the previously standalone freeze symbol producing a desired value, the gaming system may permit the player to move the previously standalone freeze symbol to yet another symbol display area in the hopes of improving the value associated with the previously standalone freeze symbol. The gaming system may enable the player to purchase more than two moves. The gaming system may permit the player to make a plurality of sequential moves without restrictions (depending on the availability of such moves). In some embodiments, the player may have obtained two or more standalone freeze symbols. Thus, purchasing multiple moves may enable the player to move one standalone freeze symbol more than once or permit the player to move two or more standalone freeze symbols. Thus, it should be appreciated that the purchase and selection of moves adds an element of skill to the game and increases the potential volatility of the game.

Once the player purchases at least one move, as indicated in block 384, the gaming system permits the player to move the standalone freeze symbol to be directly adjacent to another freeze symbol. In block 386, if the gaming system determines that the player moved the previously standalone freeze symbol to be directly adjacent to another freeze symbol, the gaming system displays a value associated with the previously standalone freeze symbol. In some embodiments, the player may have obtained only two freeze symbols. In such an embodiment, the gaming system would display a value associated with each of the two previously standalone freeze symbols.

In block 388, the gaming system determines, with the processor, a payout amount for the bonus game based on each displayed freeze symbol that is directly adjacent to another displayed freeze symbol. As should be apparent from the drawings in FIG. 3D, the process 300 also moves to block 388 when the determination outcome in block 380 is negative. In block 390, the gaming system, using the processor, updates the player's gaming credit balance in accordance with any award amount for the bonus game and may proceed to off page connector D and return to block 362 in FIG. 3B.

In some embodiments, the process of operation 300 may continue to block 380 any time a freeze symbol is generated between free spins (e.g., after block 376) and the freeze symbol is not adjacent to another freeze symbol. In such embodiments, the gaming system may return to executing the free spins discussed in FIG. 3C after the player has wagered on and executed moving one or more freeze symbols.

As indicated in block 362, the gaming system may receive a signal to end game play or "cash out" via an input device of the gaming system. In such a situation, as illustrated in block 364, the gaming system dispenses a value to the player through a value dispenser based on the player's gaming credit balance and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

FIGS. 4A-4M illustrate screen shots of one embodiment of a gaming system having improved game outcomes.

Figure 4A:
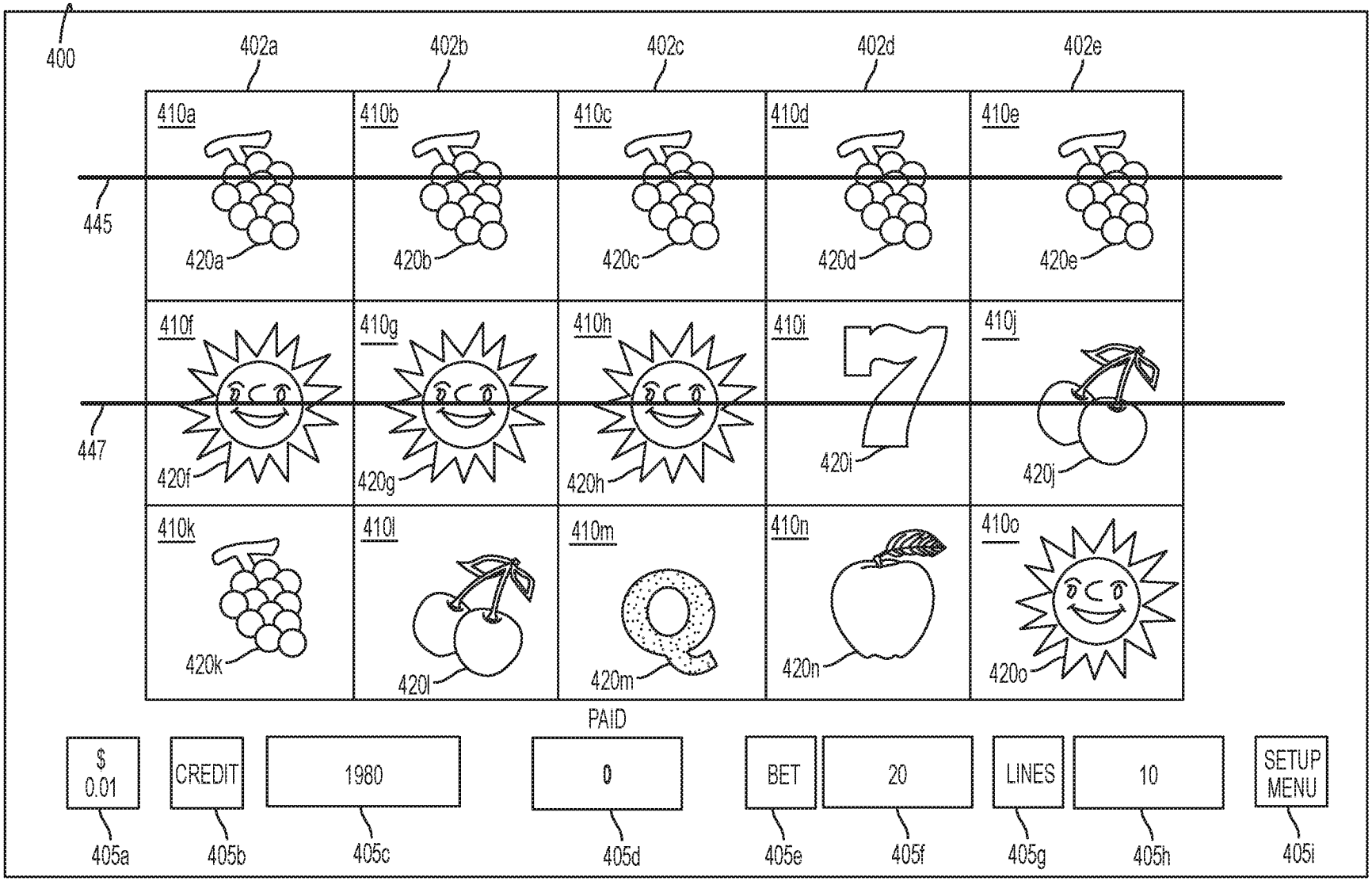
FIGS. 4A, 4B, 4C, 4D, 4E, 4F, 4G, 4H, 4I, 4J, 4K, 4L, and 4M illustrate screen shots of one embodiment of a gaming system having improvements to game outcomes.

FIG. 4A illustrates one embodiment of a game display 400 that the gaming device 100 may display on a display device of the gaming system. In one embodiment, game display 400 may be displayed on first display 122 of gaming device 100 illustrated in FIG. 1. However, any other suitable display may be used. The game display 400 displays a set of a plurality of virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements (e.g., reels, symbol display areas, symbols, etc.) shown in the game display 400. It should also be appreciated that other games may be used for the primary or base game.

The plurality of reels 402*a*-402*e* are each associated with a set of symbols, where each set of symbols includes a plurality of symbols. Each set of symbols can be associated with the same or a different plurality of symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols. In one embodiment, at least one predetermined symbol is a triggering symbol for a bonus game. In one embodiment, at least one triggering symbol must be generated on the reels during a play of a game to trigger the bonus game. In some embodiments, a plurality of triggering symbols must be generated on the reels during a play of a game to trigger the bonus game. In one embodiment, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some embodiments.

Returning now to FIG. 4A, the game display 400 depicts a plurality of symbol display areas (also referred to herein as symbol display positions) 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In one embodiment, the plurality of symbol display areas that provide the appearance of five game reels may be arranged in a manner that visibly shows three symbol positions of each of the five game reels. For example, the symbol display areas 410*a*-401*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the embodiment of FIG. 4A thus creates a visible display area of the reels 402*a*-402*e* comprising three visible symbol positions for each reel. When viewed together, reels 402*a*-402*e* appear like a 3-row by 5-column reel array in display 400. In other embodiments, smaller or larger visible areas of the reels can be displayed. That is, the reels 402*a*-402*e* may show fewer or a larger number of visible symbol display areas. While symbol display areas are illustrated with defined boxes, it should be appreciated that in some embodiments, the defined boxes are not visible to the player. It should also be appreciated that in some embodiments, the symbol display areas are other shapes or not defined shapes and may not be associated with reels.

Each reel 402*a*-402*e* may display a plurality of symbols that the gaming system generates from the sets of symbols in their respective symbol display areas as illustrated in FIG. 4A. In one embodiment, the reels may be shown spinning in one direction to simulate slot machine reels. However, it should be appreciated that the reels may be shown spinning in any suitable direction. The reels may also be shown spinning in different directions in some embodiments.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels for each of the reels 402*a*-402*e*. The spinning may appear to occur in a vertical top to bottom direction or in a vertical bottom to top direction (not shown), or in a combination of vertical directions (not shown). In one embodiment, the gaming system randomly generates symbols from the associated sets of symbols for reels 402*a*-402*e*, respectively. As noted above, the gaming system may rely on random generation performed by a pseudo RNG, a true RNG, or hardware RNG specifically designed for gaming systems. In one embodiment, the gaming system may also update the player's credit meter (information area 405*c*) to reflect the player's available credit balance. As shown in FIG. 4A, the player's credit meter (information area 405*c*) was decremented by 200 credits from 2180 to 1980 to reflect the 200 credit wager the player placed for the play of the game.

The gaming system displays the generated symbols 420*a*-420*o* in symbol display areas 410*a*-410*o* as illustrated in FIG. 4A. Symbols 420*a*-420*o* displayed on reels 402*a*-402*e* illustrate the randomly generated symbols from the set of symbols after the reels have stopped spinning. As illustrated in FIG. 4A, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*.

Figure 4B:
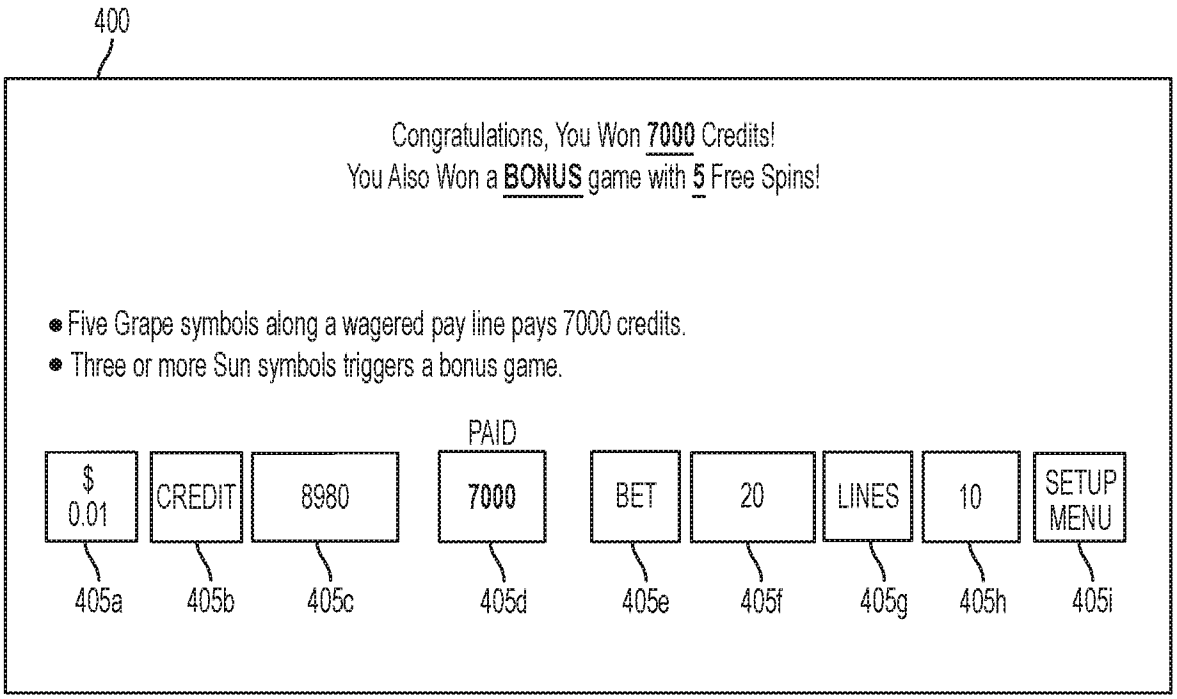

As illustrated in FIG. 4B, the gaming system generated and displayed Grape symbols (420*a*, 420*b*, 420*c*, 420*d*, 420*e*, 420*k*), Sun symbols (420*f*, 420*g*, 420*h*, 420*o*), a Seven symbol (420*i*), Cherry symbols (420*j*, 420*l*), a Queen symbol (420*m*), and an Apple symbol (420*n*) in the game display 400. It should be appreciated that the displayed symbol combinations are merely for explanatory purposes and the gaming system may randomly generate any suitable combination of symbols based on defined symbol sets associated with the reels 402*a*-402*e*.

FIG. 4A further illustrates one embodiment of a gaming system executing an evaluation of the generated symbols on reels 402*a*-402*e* for winning symbol combinations. As noted above, the player may have wagered on one or more pay lines (such as 10 pay lines shown in information area 405*h*). In one embodiment, at least the active (wagered on pay lines) are evaluated for winning symbol combinations. Any suitable number of pay lines may be used to evaluate winning symbol combinations.

In the embodiment illustrated in FIG. 4A, the gaming system evaluated the generated symbol combinations for winning symbol combinations. In FIG. 4A, the gaming system determined that a winning symbol combination is displayed across one wagered pay line. The pay line spans across a horizontal direction of symbol display areas including symbol display areas 410*a*, 410*b*, 410*c*, 410*d*, and 410*e*. In this embodiment, the gaming system displayed five Grape symbols along a horizontal pay line on which the player had placed a wager. The gaming system determined the five Grape symbols form a winning symbol combination based on a pay table associated with the gaming system (such as the base game pay table in FIG. 5). The winning pay line is illustrated as pay line 445 in FIG. 4A across the row of reels 402*a*-402*e*.

Figure 5:
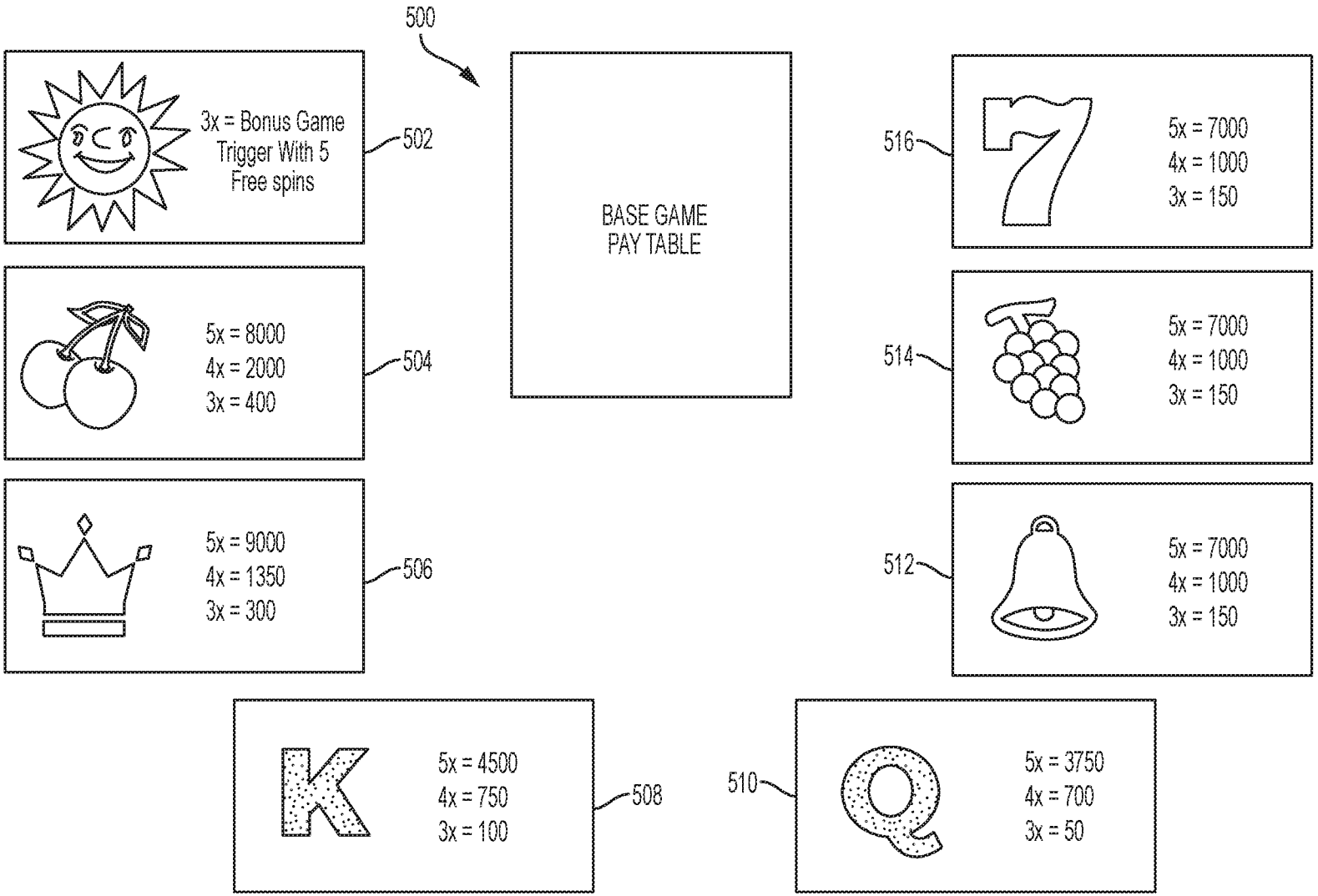
FIGS. 5 and 6 illustrate embodiments of pay tables in a gaming system having improvements to game outcomes.

As noted at block 355 of FIG. 3B, in one embodiment, the gaming system may also evaluate the generated symbols on reels 402*a*-402*e* for triggering symbols that trigger a bonus game. As illustrated in FIG. 5, a bonus game is triggered when at least three Sun symbols are generated along a pay line. The three Sun symbols also provide five free spins for the bonus game. Returning to FIG. 4A, the gaming system determined that three Sun symbols (420*f*, 420*g*, and 420*h*) were generated for the play of the game along wagered pay line 447. In the illustrated embodiment, the Sun symbol was designated as the bonus game triggering symbol. It should be appreciated that any other suitable symbol could be designed as the bonus game triggering symbol. In some embodiments, more than one different symbol can be designated as a bonus triggering symbol. In some embodiments, a combination of different triggering symbols along a pay line may be required to trigger a bonus game. In some embodiments, a predetermined quantity of scatter symbols can be used as a bonus game trigger. In some embodiments, the gaming system may highlight the Sun symbols in some manner (not shown) so that player understands that the player won a bonus game or other game features. It should be appreciated that the gaming system may highlight the bonus triggering symbol in any suitable manner. It should also be appreciated that the gaming system may not highlight the bonus triggering symbols in some embodiments, as is illustrated in FIG. 4A.

In some embodiments, the gaming system may be required to generate more than one bonus triggering symbol to activate a bonus game (as shown in pay table of FIG. 5). In other embodiments, the features available in the bonus game may depend on the quantity of bonus triggering symbols that the game system generates. In one embodiment, at least one bonus trigging symbol must be generated in the far most reel 402*a* (in any symbol display area) to trigger the bonus game. That is, if the at least one bonus triggering symbol is generated in reels 402*b*, 402*c*, 402*d*, or 402*e*, the gaming system may not activate the bonus game. However, in other embodiments, the bonus triggering symbol may appear on any reel in any symbol display area to trigger the bonus game. In some embodiments, the gaming system may evaluate the bonus triggering symbols from a left to right direction along the reels. In some embodiments, the gaming system may evaluate the bonus triggering symbols from a right to left direction along the reels.

Returning to FIG. 4A, the gaming system determined that three triggering symbols (the Sun symbols 420*f*, 420*g*, and 420*h*) were generated on reels 402*a*, 402*b*, and 402*c* in symbol display areas 410*f*, 410*g*, and 410*h*. Based on the generated bonus triggering symbol on such reels along wagered pay line 447, the gaming system activates a bonus game.

Figure 6:
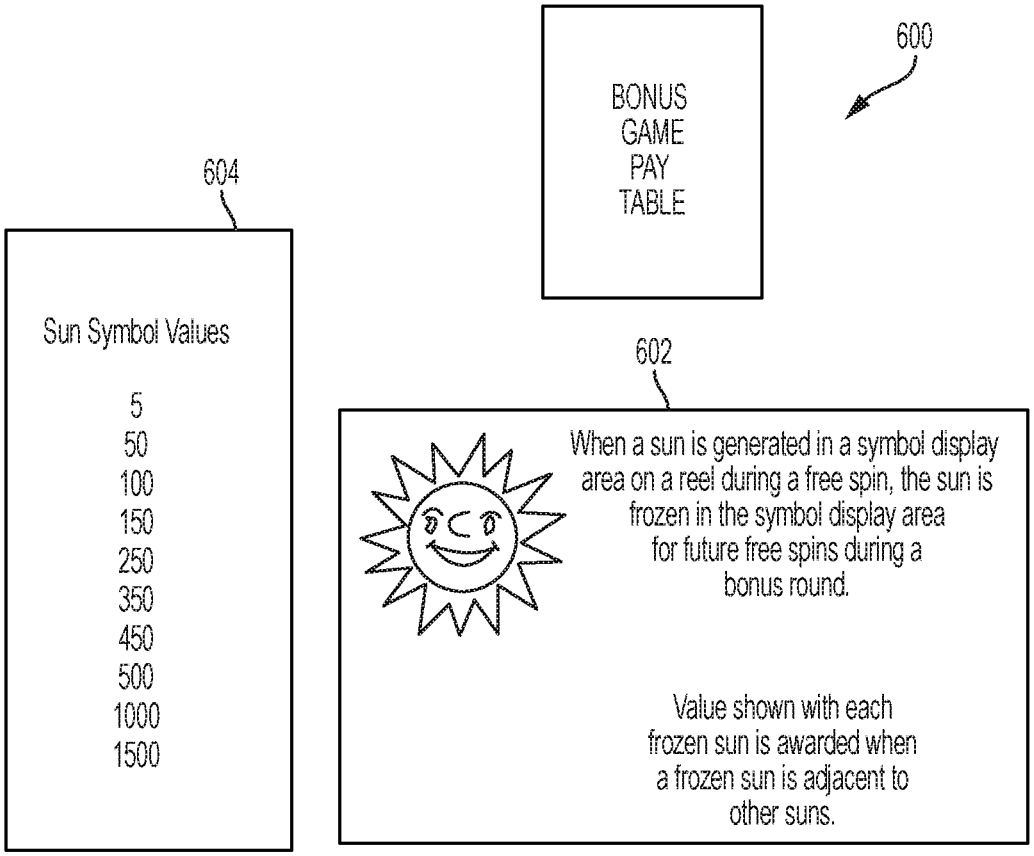

In one embodiment, the gaming system uses the same symbol sets associated with the same reels for both the primary game and the bonus game, but changes the pay table for the bonus game. As illustrated in FIG. 6, the gaming system switches to a pay table 600 that provides pays for Sun symbols generated in a certain manner. Unlike the pay table in FIG. 5, the FIG. 6 pay table 600 indicates that Sun symbols can be awarded a plurality of different values from table 604. Pay table 600 also indicated that when Sun symbols are generated in the bonus game, the Sun symbol will be frozen (or persistent) in its displayed location for the duration of the bonus game. A value associated with a Sun symbol is displayed and awarded when a displayed frozen Sun symbols is directly adjacent to (e.g., touching) at least one other displayed frozen Sun symbol. In other words, Sun symbols pay when Sun symbols are generated in contiguous blocks (or groups) of Sun symbols in the symbol display areas. For example, directly adjacent or touching means that the gaming system generated a Sun symbol that shares at least one symbol display area border with another symbol display area border that includes a generated Sun symbol. As a more specific example, directly adjacent or touching means that the gaming system generated a Sun symbol in symbol display area 410*h* and also at least one other Sun symbol in symbol display areas 410*c*, 410*i*, 410*g*, or 410*m*. These two directly adjacent Sun symbols would create a contiguous block or group of Sun symbols. In some embodiments, the Sun symbols are substantially adjacent or substantially touching. It should be appreciated that in some embodiments, the Sun symbols do not need to actually touch to be adjacent or in a contiguous block (or group).

In some embodiments, when the bonus game is initiated, the gaming system generates and assigns a Sun symbol value (based on the Sun value table 604) to each symbol display area. In such an embodiment, when the gaming system generates a Sun symbol in a particular symbol display area, the Sun symbol obtains its associated value. In alternative embodiments, the gaming system generates and assigns a value from table 604 to each Sun symbol in each set of symbols associated with the respective reels 402*a*-402*e*. These values can be assigned before, during, or after the Sun symbols are generated for display in the bonus game. In one embodiment, as the gaming system generates a Sun symbol for display in the bonus game, the gaming system also generates an associated value from table 604. In some embodiments, values associated with generated and displayed Sun symbols are not shown to the player unless the displayed Sun symbols are in a contiguous block of at least two Sun symbols. Thus, in some embodiments, the player is not shown the value associated with a standalone Sun symbol (e.g., a Sun symbol not in a contiguous block or touching any other Sun symbol). In some embodiments, the values associated with a generated and displayed Sun symbols are shown to a player when the Sun symbols are displayed in symbol display areas, regardless of whether the Sun symbols are part of a contiguous block of at least two Sun symbols. In some embodiments, if a Sun symbol is moved from one symbol display area to another symbol display area, the value associated with the Sun symbol can change. Sun symbol movement for game outcome improvement is discussed in further detail below.

Turning now to FIG. 4B, the gaming system in one embodiment provides the player with information regarding all of the awards for the play of the base game. In this embodiment, the gaming system alerts the player that the player won 7000 credits, a bonus game, and 5 free spins in the bonus game. In some embodiments, the gaming system may break down how the player won the credits and free spin bonus game. For example, the gaming system may describe that the five Grape symbols along a wagered pay line pays 7000 credits (e.g., based on the pay table illustrated in FIG. 5). The gaming system may also indicate that Sun symbols trigger the bonus game. It should be appreciated that the quantity of free spins may be predetermined or randomly generated. In some embodiments, the quantity of awarded free spins may be based on the player's wager, where higher wagers may result in a greater quantity of free spins than lower wagers. It should be appreciated that in some embodiments, the obtaining greater quantities of Sun symbols in the base game along a wagered pay line may result in a greater number of free spins. It should also be appreciated that the awards illustrated in FIG. 4B and FIG. 5 are merely illustrative and could be adjusted to include any suitable awards and different credit amounts.

As illustrated in FIG. 4B, the gaming system awards the appropriate number of credits to the player and updates the player's win meter (shown in information area 405*d*) to reflect the player's winnings during the play of the game. In one embodiment, the gaming system may also update the player's credit meter (information area 405*c*) to reflect the player's available credit balance.

If the player did not win a bonus game, the player may continue the gaming session by playing another game. That is, the player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Figure 4C:
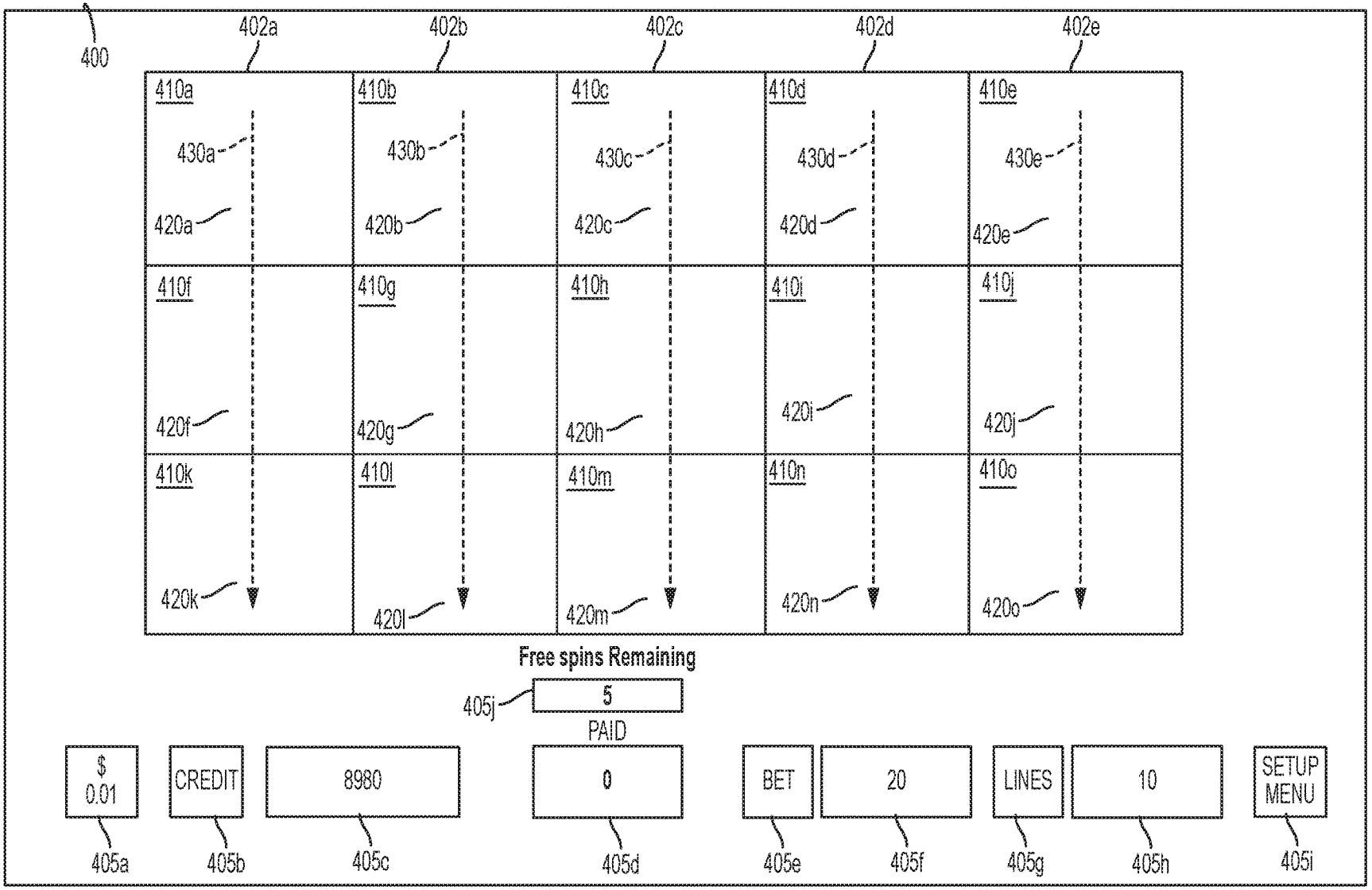

FIG. 4C illustrates one embodiment where the player won a bonus game with free spins. In one embodiment, the gaming system may automatically start the bonus game and executes the free spins (to generate a new plurality of symbols for display on the reels), where each free spin is a play of the bonus game. In one embodiment, the gaming system may automatically continue executing the available free spins until no free spins remain. In one alternative embodiment, the gaming system may enable the player to manually start one or more free spins in the bonus game. FIG. 4C further illustrates each of reels 402*a*-402*e* spinning for a first generation of symbols on the reels. Spin direction 430*a*, 430*b*, 430*c*, 430*d*, and 430*e* illustrate the spin direction of the reels in FIG. 4C. Free spin balance meter 405*j* also shows the player how many free spins remain in the bonus game. The gaming system updated the player's win meter (shown in information area 405*d*) to reflect that the player has not yet won any awards during the bonus game.

Figure 4D:
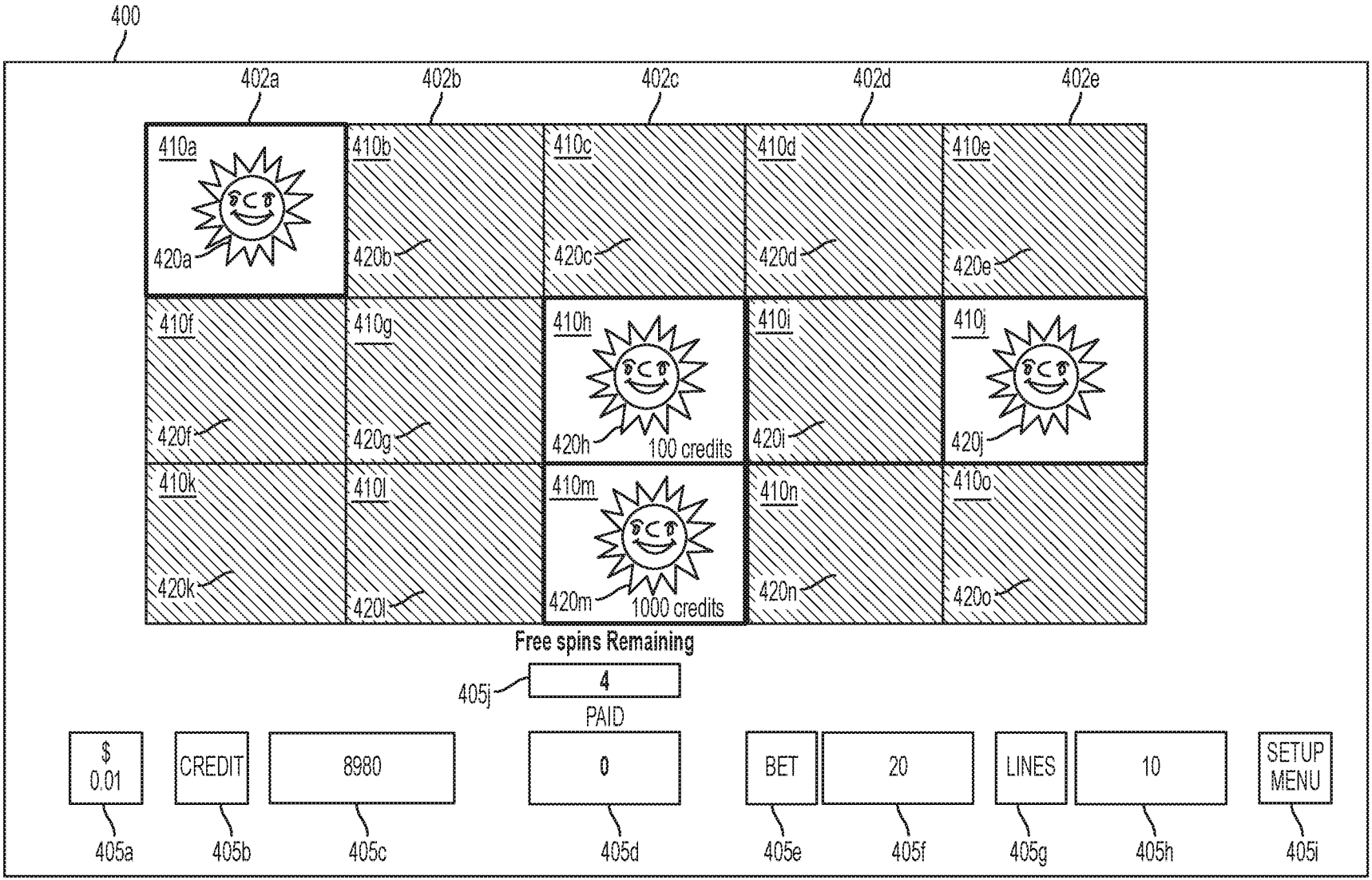

As illustrated in FIG. 4D, the gaming system randomly generated symbols 420*a*-420*o* from the sets of symbols associated with reels 402*a*-402*e*, respectively. As noted above, the gaming system may rely on random symbol generation performed by a pseudo RNG, a true RNG, or hardware RNG to generate the symbols for the bonus game. In one embodiment, the gaming system may also update the player's free spin balance meter (information area 405*j*) to reflect the player's available free spin balance. In the bonus game with free spins, the player's credit meter will generally either increase or remain the same, depending on winning outcomes. For example, the gaming system may award the player with additional free spins for certain game outcomes, such as obtaining a predetermined quantity of contiguous Sun symbols. In some bonus game embodiments, it should be appreciated that the player may use additional credits for some aspect of a bonus game.

The gaming system displays the generated symbols 420*a*-420*o* in symbol display areas 410*a*-4010 as illustrated in FIG. 4D. Symbols 420*a*-420*o* displayed on reels 402*a*-402*e* illustrate the randomly generated symbols after the reels have stopped spinning. As illustrated in FIG. 4D, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*. For purposes of illustration, symbols 420*b*-420*g*, 420*i*, 420*k*, 420*l*, 420*n*, and 420*o* are obscured from view because these symbols were not Sun symbols and accordingly did not provide a payout award according to the bonus pay table in FIG. 6. In some embodiments, the symbols 420*b*-420*g*, 420*i*, 420*k*, 420*l*, 420*n*, and 420*o* may be partially visible or completely visible.

As illustrated in FIG. 4D, the gaming system generated and displayed Sun symbols (420*a*, 420*h*, 420*j*, and 420*m*) in symbol display areas 410*a*, 410*h*, 410*j*, and 410*m* in the game display 400. It should be appreciated that the displayed symbol combinations are merely for explanatory purposes and the gaming system may randomly generate any suitable combination of symbols based on defined symbol sets associated with their respective reels. In one embodiment, as illustrated in the pay table of FIG. 6, the Sun symbols were designated as pay symbols when meeting certain conditions. As previously noted, the Sun symbols are also persistent symbols or freeze symbols, which generally remain in the symbol display area during a bonus game once generated and displayed during a free spin of the bonus game. It should be appreciated that any suitable symbol can be designated as the persistent symbol, freeze symbol, or frozen symbol. More than one symbol can be designated as the persistent symbol in some embodiments.

FIG. 4D illustrates that Sun symbols 420*a* and 420*j* do not show associated values. In this embodiment, Sun symbols that are not part of a contiguous group of Sun symbols are not assigned their associated value. In the embodiment discussed in FIGS. 4D-4M, the gaming system randomly generated and associated values from table 604 with each of the symbol display areas 410*a*-410*o*. The generated and displayed Sun symbols get assigned the values associated with the symbol display area when the Sun symbols are displayed as part of a contiguous group of Sun symbols. As illustrated in FIG. 4D, Sun symbol 420*h* and Sun symbol 420*m* are part of contiguous group of Sun symbols (they are each connected to another Sun symbol/directly adjacent to another Sun symbol in an adjacent symbol display area). Thus, Sun symbol 420*h* is assigned the value of 100 credits and Sun symbol 420*m* is assigned the value of 1000 credits (e.g., values randomly associated with the respective symbol display areas from table 604). If a Sun symbol was generated and displayed in symbol display area 410*e*, 410*i*, or 410*o*, then Sun symbol 420*j* would also have been connected to another Sun symbol and would have received the value assigned to symbol display area 410*j*. As noted above, once a Sun symbol is generated and displayed during a bonus game, the Sun symbol will remain displayed for the remainder of the bonus game. As such, Sun symbols, 420*a*, 420*h*, 420*j*, and 420*m* are persistently displayed on display device 400 through each remaining free spin of the bonus game. In subsequent free spins of the bonus game, the player hopes that the gaming system will generate additional Sun symbols that are connected to already displayed Sun symbols 420*a*, 420*h*, 420*j*, and 420*m* to improve the player's bonus award. In some embodiments, the gaming system may execute an evaluation of the generated symbols on reels 402*a*-402*e* for winning symbol combinations (e.g., connected Sun symbols) and update information area 405*d* after each free spin. In other embodiments, as is illustrated in FIGS. 4A-4M, the gaming system may wait until all free spins have been exhausted before updating information area 405*d* with the player's award for the bonus game.

Figure 4E:
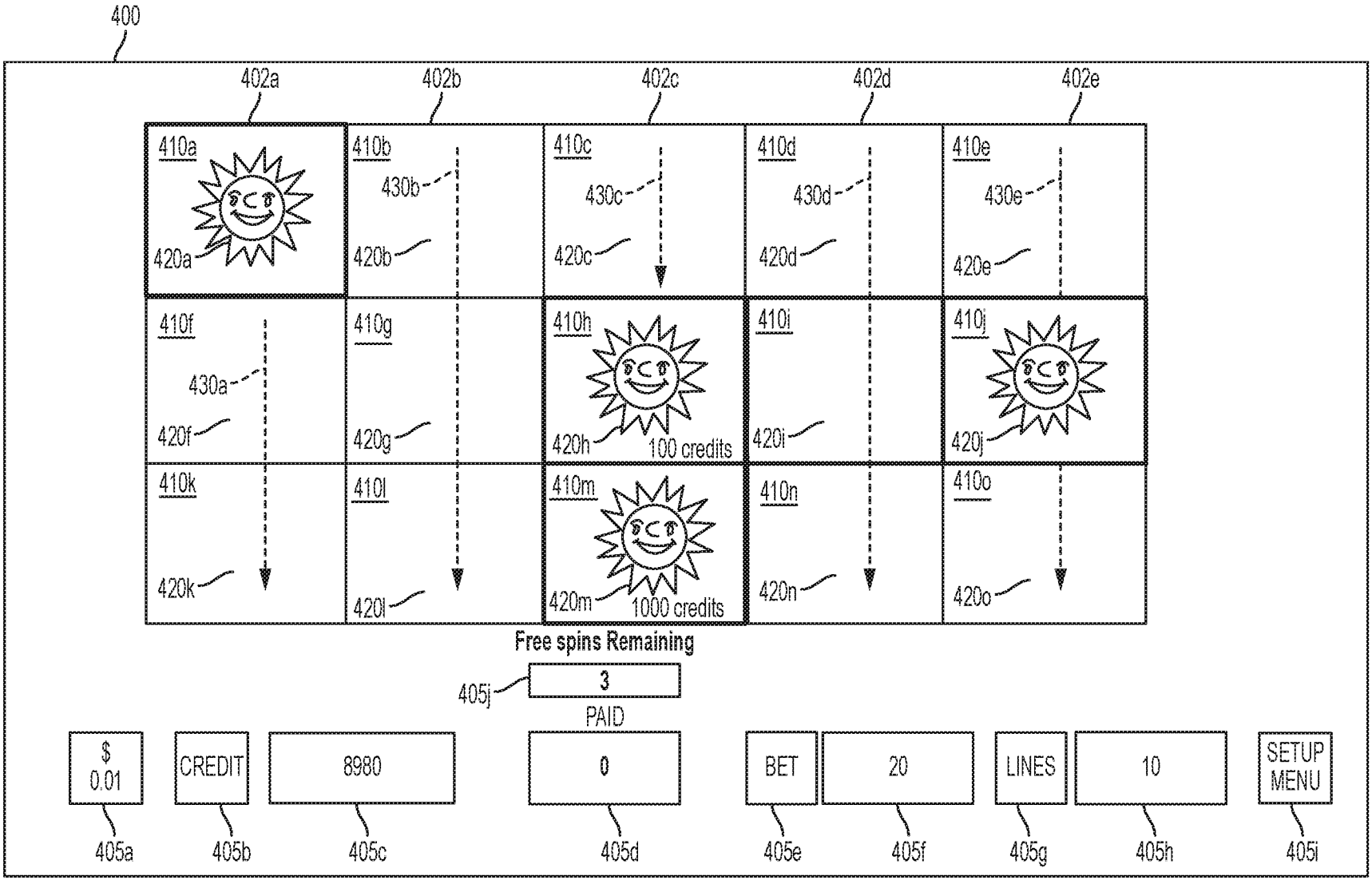

Turning to FIG. 4E, the gaming system executes another free spin of the bonus game. Specifically, FIG. 4E illustrates each of reels 402*a*-402*e* spinning for a second generation of symbols on the reels. Spin direction 430*a*, 430*b*, 430*c*, 430*d*, and 430*e* illustrate the spin direction of the reels in FIG. 4E. The gaming system updated free spin balance meter 405*j* to show the player that three free spins remain in the bonus game. Persistent Sun symbols 420*a*, 420*h*, 420*j*, and 420*m* remain displayed through the new free spin of the bonus round.

While not illustrated in FIG. 4E, in one embodiment, the spinning reels 402*a*-402*e* are fully spinning (not just for symbol display areas without persistent Sun symbols) and can generate new symbols for each symbol display area 410*a*-410*o*, even where a persistent Sun symbol is already displayed). Thus, in some embodiments, a displayed persistent Sun symbol is formed as a layer over the reels 402*a*-402*e*. In some such embodiments, the reel strip (or the set of symbols for a reel is not altered by a persistent Sun symbol in symbol display area). Yet in other embodiments, the reel strip can be modified to remove any Sun symbols that have been displayed on the reels.

In some embodiments, once a Sun symbol has been generated in symbol display area, even if the gaming system generates new symbols in the same symbol display area for subsequent free spins in a bonus game, the gaming system will not replace the existing displayed Sun symbol. For example, even if the gaming system generated a new symbol for symbol display area 410*a* for the second free spin, the gaming system will not replace the Sun symbol. It should be appreciated that other embodiments are possible where the gaming system can replace a persistent Sun symbol that has already been displayed. For example, in an embodiment where Sun symbols are associated with values independent of a symbol display area, the gaming system may replace a lower value Sun symbol with a higher value Sun symbol in a particular symbol display area to improve the player's award.

Figure 4F:
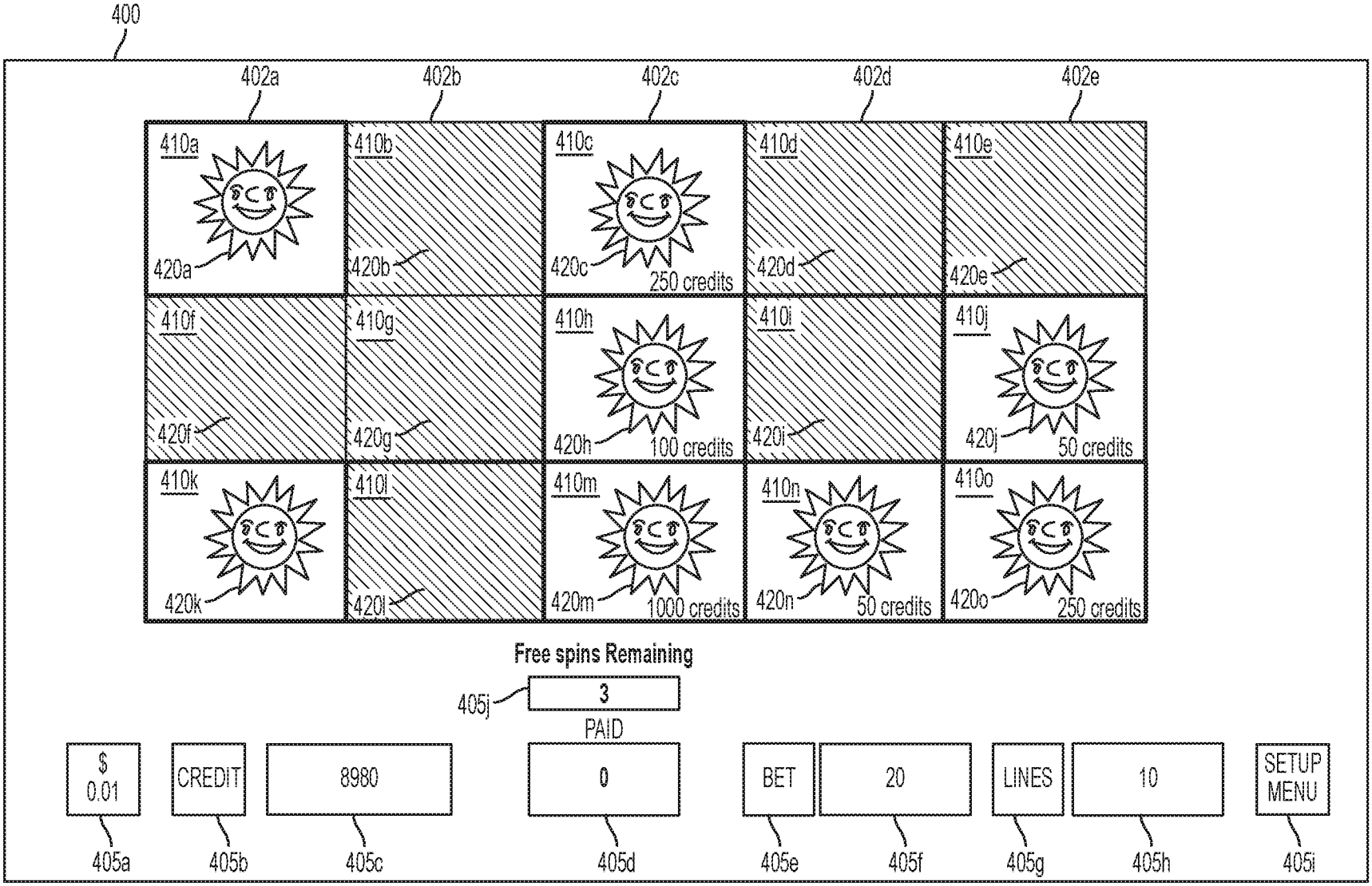

As illustrated in FIG. 4F, the gaming system randomly generated symbols 420*a*-420*o* from the sets of symbols associated with reels 402*a*-402*e*, respectively. As noted above, the gaming system may rely on random symbol generation performed by a pseudo RNG, a true RNG, or hardware RNG to generate the symbols for the bonus game. In one embodiment, the gaming system may also update the player's free spin balance meter (information area 405*j*) to reflect the player's available free spin balance if it was not already updated.

The gaming system displays the generated symbols 420*a*-420*o* in symbol display areas 410*a*-4010 as illustrated in FIG. 4F. Symbols 420*a*-420*o* displayed on reels 402*a*-402*e* illustrate the randomly generated symbols after the reels have stopped spinning. As illustrated in FIG. 4F, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*. As noted above, for purposes of illustration, symbols 420*b*, 420*d*-420*g*, 420*i*, and 420*l* are obscured from view because these symbols were not Sun symbols and accordingly did not provide a payout award according to the bonus pay table in FIG. 6. In some embodiments, the symbols 420*b*-420*g*, 420*i*, and 420*l* may be partially visible or completely visible. In some embodiments, the gaming system may use a pay table that provides awards to various symbol combinations (similar to the symbol combination awards shown in FIG. 5 in addition to the Sun symbol combination awards).

As illustrated in FIG. 4F, the gaming system generated and displayed new Sun symbols 420*c*, 420*k*, 420*n*, and 420*o* in symbol display areas 410*c*, 410*k*, 410*n*, and 410*o* that add to the previously generated Sun symbols 420*a*, 420*h*, 420*j*, and 420*m* in symbol display areas 410*a*, 410*h*, 410*j*, and 410*m* in the game display 400. FIG. 4F further illustrates that Sun symbols 420*a* and 420*k* do not show associated values because these Sun symbols are not part of a contiguous group of Sun symbols. However, as illustrated in FIG. 4F, Sun symbol 420*c*, 420*h*, 420*j*, 420*m*, 420*n*, and 420*o* are all part of a contiguous group of Sun symbols (they are each connected to another Sun symbol/directly adjacent to another Sun symbol in an adjacent symbol display area). Thus, Sun symbols 420*c*, 420*h*, 420*j*, 420*m*, 420*n*, and 420*o* are respectively assigned the values 250, 100, 50, 1000, 50, and 250 credits. Sun symbols, 420*a*, 420*c*, 420*h*, 420*j*, 420*k*, 420*m*, 420*n*, and 420*o* are persistently displayed on display device 400 through each remaining free spin of the bonus game. In subsequent free spins, the player hopes that the gaming system will generate additional Sun symbols that are connected to already displayed Sun symbols 420*a*, 420*c*, 420*h*, 420*j*, 420*k*, 420*m*, 420*n*, and 420*o* to improve the player's award. In some embodiments, the gaming system evaluates all symbols generated and displayed for this free spin illustrated in FIG. 4F. However, in some embodiments, the gaming system skips evaluating symbols that are not Sun symbols. By skipping evaluation of all of the generated and displayed symbols, the efficiency of the gaming system can be improved because less memory and less processing power is used during the gaming system's evaluation after each free spin. This efficiency also translates into faster game play because less time is used to complete the game's evaluation. When such efficiency improvements are made and applied to the hundreds and thousands of games evaluations that are made on a casino floor for the disclosed gaming system, the new gaming system will provide casino game operators sizable gains in machine efficiency.

Figure 4G:
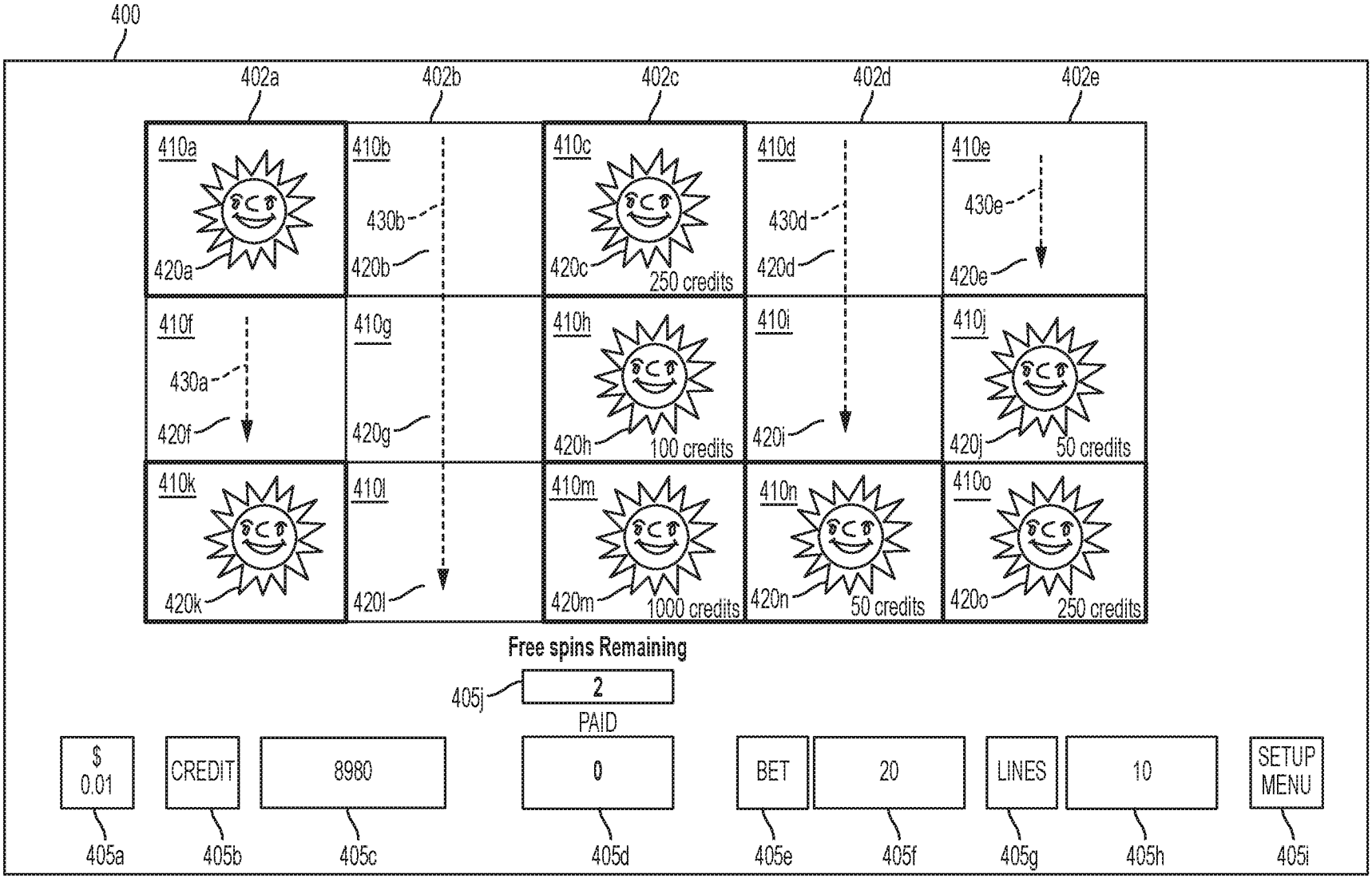

Turning to FIG. 4G, the gaming system executes another free spin of the bonus game. Specifically, FIG. 4G illustrates each of reels 402*a*-402*e* spinning for a third generation of symbols on the reels. Spin direction 430*a*, 430*b*, 430*d*, and 430*e* illustrate the spin direction of the reels in FIG. 4G. The gaming system updated the free spin balance meter 405*j* to show the player that two free spins remain in the bonus game. Persistent Sun symbols 420*a*, 420*c*, 420*h*, 420*j*, 420*k*, 420*m*, 420*n*, and 420*o* remain displayed through the new free spin of the bonus round.

As noted above, while not illustrated in FIG. 4G, in one embodiment, the spinning reels 402*a*-402*e* are fully spinning (not just for symbol display areas without persistent Sun symbols) and can generate new symbols for each symbol display area 410*a*-410*o* (even where a persistent Sun symbol is already displayed). It should also be appreciated that in some embodiments, the gaming system generates symbols for symbol display areas that have not yet obtained a persistent Sun symbol (e.g., symbol display areas 410*b*, 410*d*-410*g*, 410*i*, and 410*l*). This reduction in symbol generation reduces the amount of memory and processing power used for the gaming system and creates a more efficient gaming system.

While not shown, the gaming system randomly generated symbols 420*a*-420*o* from the sets of symbols associated with reels 402*a*-402*e*, respectively. As noted above, the gaming system may rely on random symbol generation performed by a pseudo RNG, a true RNG, or hardware RNG to generate the symbols for the bonus game. In one embodiment, the gaming system may also update the player's free spin balance meter (information area 405*j*) to reflect the player's available free spin balance if it was not already updated.

Figure 4H:
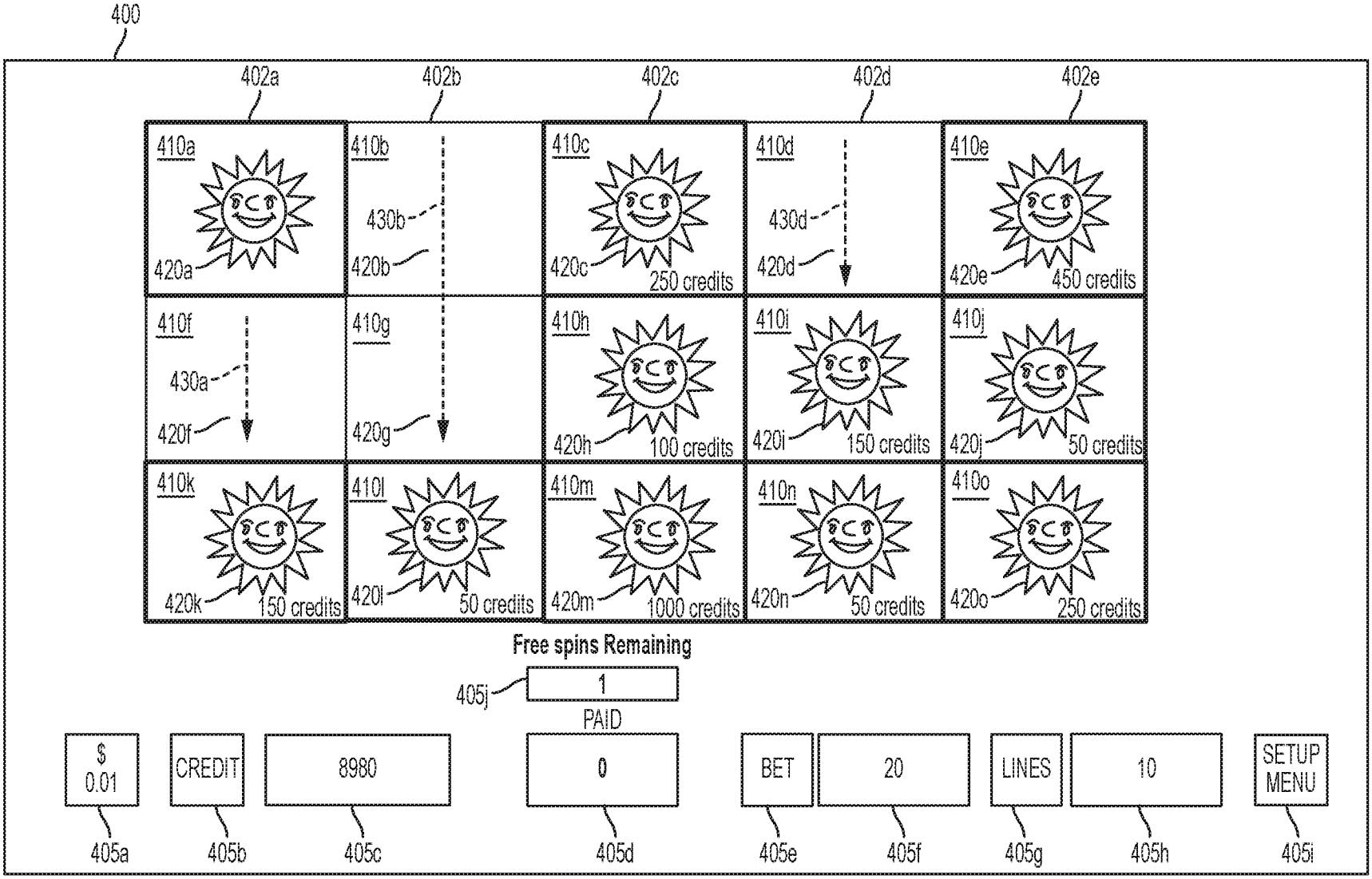

For the sake of brevity, a screen shot of the generated symbols after reels are spun in FIG. 4G is not shown. The gaming system would display the generated symbols 420*a*-420*o* in symbol display areas 410*a*-401*o*. Symbols 420*a*-420*o* displayed on reels 402*a*-402*e* would have shown the randomly generated symbols after the reels have stopped spinning. As can be seen in FIG. 4H, the gaming system generated new Sun symbols 420*e*, 420*i*, and 420*l* in symbol display areas 410*e*, 410*i*, and 410*l*, respectively. In FIG. 4H, Sun symbols 420*c*, 420*e*, 420*h*, 420*i*, 420*j*, 420*k*, 420*l*, 420*m*, 420*n*, and 420*o* are all part of the contiguous group of Sun symbols (they are each connected to another Sun symbol/directly adjacent to another Sun symbol in an adjacent symbol display area). Thus, Sun symbols 420*c*, 420*e*, 420*h*, 420*i*, 420*j*, 420*k*, 420*l*, 420*m*, 420*n*, and 420*o* are respectively assigned the values 250, 450, 100, 150, 50, 150, 50, 1000, 50, and 250 credits. Sun symbol 420*a* remains a standalone Sun symbol and is not assigned a value. Sun symbols 420*a*, 420*c*, 420*e*, 420*h*, 420*i*, 420*j*, 420*k*, 420*l*, 420*m*, 420*n*, and 420*o* are persistently displayed on display device 400 through each remaining free spin of the bonus game. In subsequent free spins, the player hopes that the gaming system will generate additional Sun symbols that are connected to already displayed contiguous group of Sun symbols 420*c*, 420*e*, 420*h*, 420*i*, 420*j*, 420*k*, 420*l*, 420*m*, 420*n*, and 420*o* to improve the player's award.

In FIG. 4H, the gaming system illustrates execution of another free spin of the bonus game. Specifically, FIG. 4H illustrates each of reels 402*a*-402*e* spinning for a fourth generation of symbols on the reels. Spin direction 430*a*, 430*b*, and 430*d* illustrate the spin direction of the reels in FIG. 4G. The gaming system updated free spin balance meter 405*j* to show the player that one free spin remains in the bonus game. Persistent Sun symbols 420*a*, 420*c*, 420*e*, 420*h*, 420*i*, 420*j*, 420*k*, 420*l*, 420*m*, 420*n*, and 420*o* remain displayed through the new free spin of the bonus round.

As noted above, while not illustrated in FIG. 4H, in one embodiment, the spinning reels 402*a*-402*e* are fully spinning (not just for symbol display areas without persistent Sun symbols) and can generate new symbols for each symbol display area 410*a*-410*o*, even where a persistent Sun symbol is already displayed).

Figure 4I:
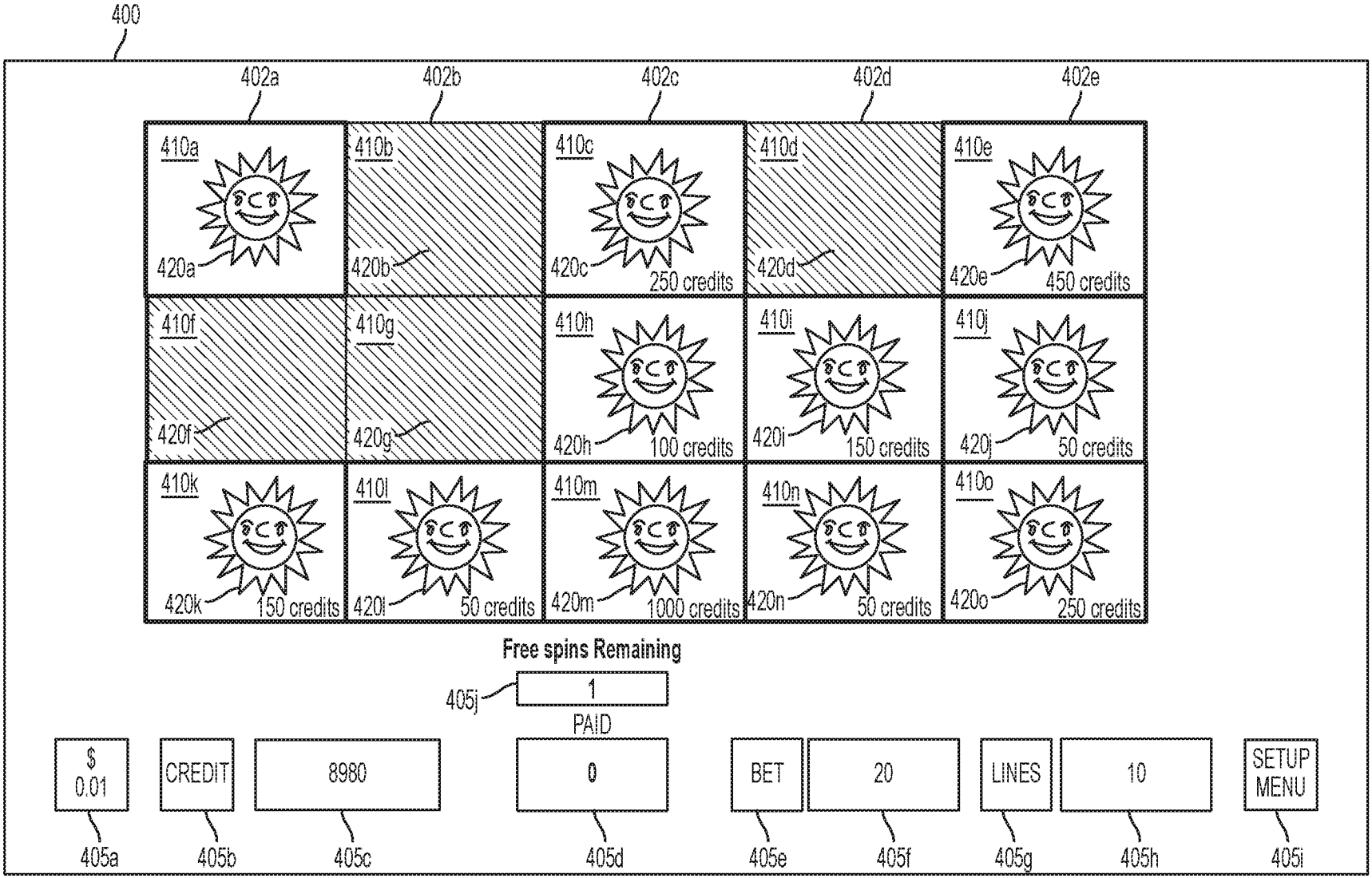

The gaming system randomly generated symbols 420*a*-420*o* from the sets of symbols associated with reels 402*a*-402*e*, respectively. As noted above, the gaming system may rely on random symbol generation performed by a pseudo RNG, a true RNG, or hardware RNG to generate the symbols for the bonus game. As illustrated in FIG. 4I, the gaming system displayed the generated symbols 420*a*-420*o* in symbol display areas 410*a*-401*o*. Symbols 420*a*-420*o* displayed on reels 402*a*-402*e* show the randomly generated symbols after the reels have stopped spinning. As can be seen in FIG. 4I, the gaming system did not generate and display new Sun symbols in the open symbol display areas 410*b*, 410*d*, 410*f*, or 410*g*. Thus, Sun symbol 420*a* remains a standalone Sun symbol, is not assigned a value, and the player did not improve the player's bonus game award in the most recent free spin. Sun symbols 420*a*, 420*c*, 420*e*, 420*h*, 420*i*, 420*j*, 420*k*, 420*l*, 420*m*, 420*n*, and 420*o* are persistently displayed on display device 400 through each remaining free spin of the bonus game. In subsequent free spins, the player hopes that the gaming system will generate additional Sun symbols that are connected to the already displayed contiguous group of Sun symbols 420*c*, 420*e*, 420*h*, 420*i*, 420*j*, 420*k*, 420*l*, 420*m*, 420*n*, and 420*o* to improve the player award.

Figure 4J:
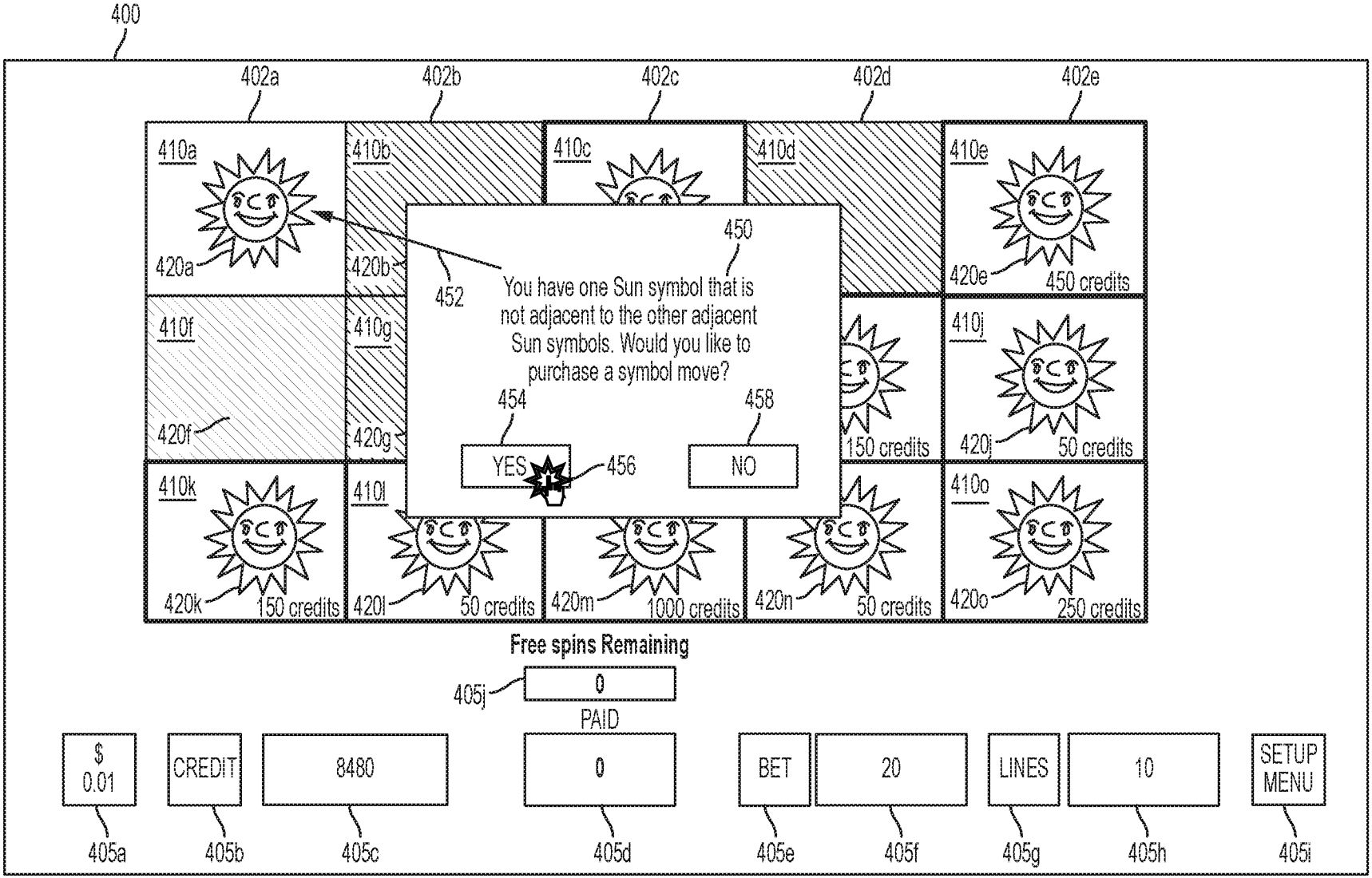

For the sake of brevity, the gaming system executed the final remaining free spin. As illustrated in FIG. 4J, the gaming system displayed the generated symbols 420*a*-420*o* in symbol display areas 410*a*-410*o*. Symbols 420*a*-420*o* displayed on reels 402*a*-402*e* show the randomly generated symbols after the reels have stopped spinning. As can be seen in FIG. 4J, the gaming system again did not generate and display new Sun symbols in the open symbol display areas 410*b*, 410*d*, 410*f*, or 410*g*. Thus, Sun symbol 420*a* remains a standalone Sun symbol, is not assigned a value, and the player did not improve the player's bonus game award in the last free spin of the bonus game.

The standalone Sun symbol 420*a* creates a great disappointment for the player because the player sees that in the final two free spins, the gaming system simply needed to generate a Sun symbol in symbol display area 410*b* or 410*f* to add such new Sun symbol and Sun symbol 420*a* to the contiguous group of Sun symbols 420*c*, 420*e*, 420*h*, 420*i*, 420*j*, 420*k*, 420*l*, 420*m*, 420*n*, and 420*o* to potentially greatly improve the player's bonus award.

In one such embodiment, the gaming system offers the player the ability to move or to purchase the ability to move Sun symbol 420*a* to an adjacent symbol display area without an existing Sun symbol (e.g., symbol display areas 410*b*, 410*f*, or 410*g*). For example, the gaming system may generate and display a message 450 that enables the player to wager or purchase a Sun symbol move. In one embodiment, the message also tells the player which Sun symbol the move would apply to (e.g., with an indicator like arrow 452). As shown in FIG. 4J, the gaming system enables the player to make a selection from two buttons 454 and 458 on display 400. In some embodiments, the gaming system enables the player to make the selection from hardware buttons. As shown in FIG. 4J, the player selects the YES button 454 with cursor 456. The amount of the purchase or wager may vary to obtain a symbol move. As illustrated in FIG. 4J, the gaming system deducted 500 credits for the move purchase and updated information area 405*c* to reflect the 500 credit deduction. The purchase value of a move may depend on what award the player may potentially win. In the illustrated embodiment of FIG. 4J, the player stands to win a substantial amount of credits, thus the purchase price might be set higher than if the player's total win value is lower (e.g., fewer persistent Sun symbols in a contiguous group were generated during the bonus game). In some embodiments, the gaming system offers the player the opportunity to purchase moves before, during, or after the game (e.g., after the final free spins have been generated). In some embodiments, the cost to purchase a move increases as the game progresses (e.g., it would be cheaper to purchase a move at the start of a game rather than after the gaming system finished generating all of the free spins). In some embodiments, the gaming system may purchase more than one move as noted above. The multiple moves can be applied to one Sun symbol (e.g., Sun symbol 420*a*) or to fewer moves for a plurality of different Sun symbols.

In some embodiments, the gaming system automatically moves Sun symbol 420*a* to an adjacent symbol display area without an existing Sun symbol (e.g., symbol display areas 410*b*, 410*f*, or 410*g*) without requiring a player selection. In one embodiment, the gaming system automatically moves Sun symbol 420*a* to an adjacent symbol display area based on a random determination of available symbol display areas (e.g., randomly selecting one of symbol display areas 410*b*, 410*f*, and 410*g*). In some such embodiments, when the gaming system automatically and randomly moves the Sun symbol 420*a* to an available symbol display area, the move could be associated with any suitable credit award or no credit awards. In still other embodiments, the gaming system automatically moves Sun symbol 420*a* to an adjacent symbol display area based on a determination of an optimum move to available symbol display areas. For example, if one of three moves are available and two of the moves are each worth 5 credits (for a low value improvement) and one of the moves is worth 1500 credits, the gaming system determines that the move resulting in 1500 credits is the optimum move and the gaming system will automatically move the Sun symbol 420*a* to the symbol display area that will result in the player obtaining the extra 1500 credits.

Figure 4K:
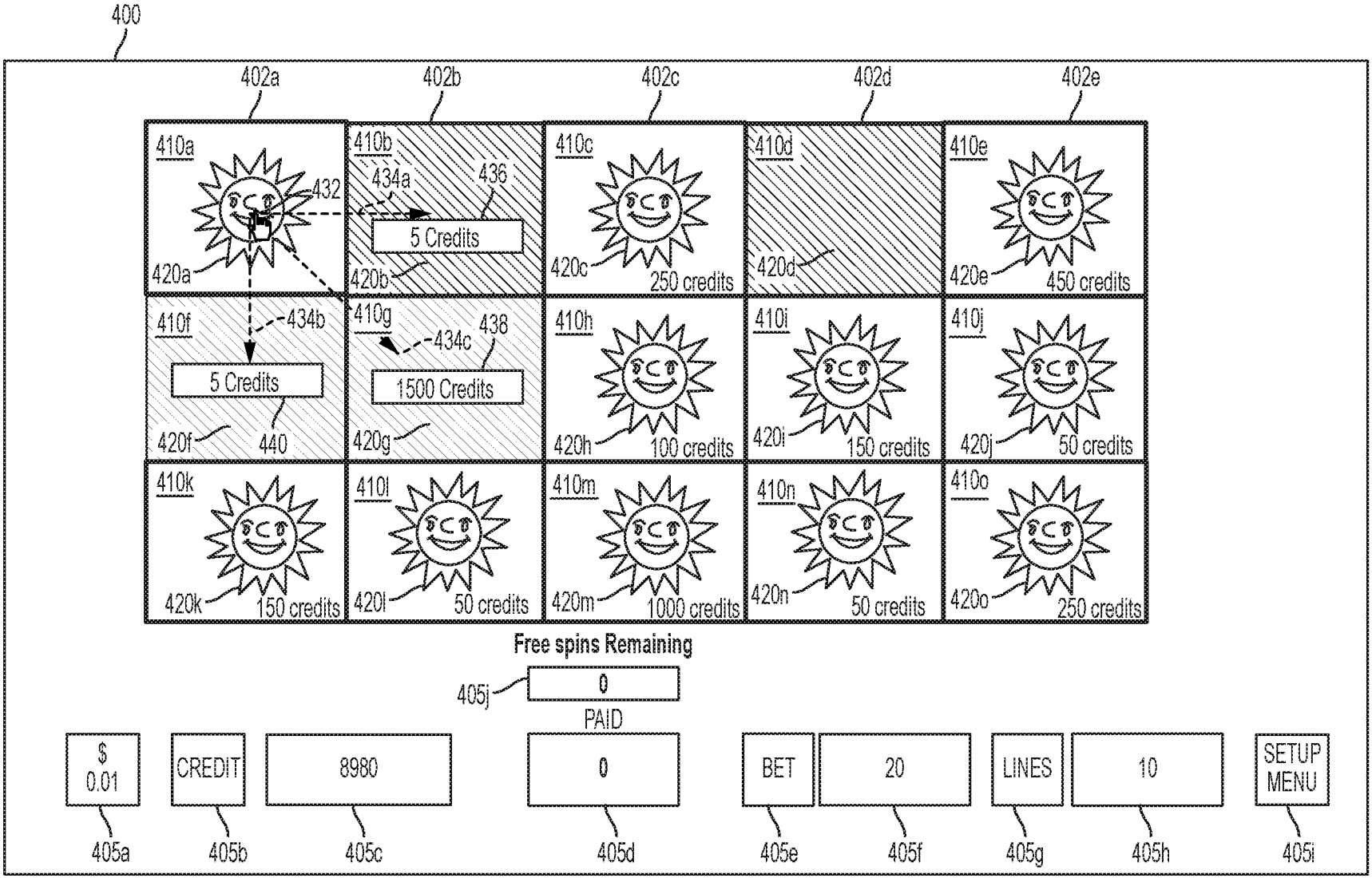

In some embodiments, the gaming system attempts to entice the player with award values that the player could win if the player purchases a move. For example, the gaming system may inform the player that one of three moves are available and that two of the moves are each worth 5 credits (for a low value improvement) and one of the moves is worth 1500 credits. As illustrated in FIG. 4K, the gaming system enables the player to move the Sun symbol 420*a* in direction 434*a*, 434*b*, or 434*c*. While the credit values 436, 438, and 440 associated with each symbol display area are shown in FIG. 4K, they are shown for illustration purposes. The player is typically not shown which move has a higher or lower value than other moves. In some embodiments, the gaming system permits the player to move in any direction (e.g., up, down, left, right, diagonal). In some embodiments the move directions may be restricted. In some embodiments, different moves have different purchase prices. In some embodiments, the gaming system may offer the player multiple different choices with multiple different symbols. In some such embodiments, the gaming system may introduce a level of strategy that the player must use to make the move selection and obtain the highest award. For example, the player may be offered two different contiguous groups of Sun symbols, but the gaming system will restrict the player's payout for one contiguous group of Sun symbols. Thus, the player must choose the one contiguous group of Sun symbols that results in the highest value. The player must correctly add up the values of the different contiguous groups and determine which one of the groups the Sun symbol should be moved to, to obtain the highest award value.

In some embodiments, the player can purchase a move and also purchase a move protection. For example, if the player purchases a move and makes a move that does not improve the player's award (or in some embodiments, reduces the player's award), the player can purchase an additional protection that permits the player to retain the award the player originally obtained prior to making any moves.

Figure 4L:
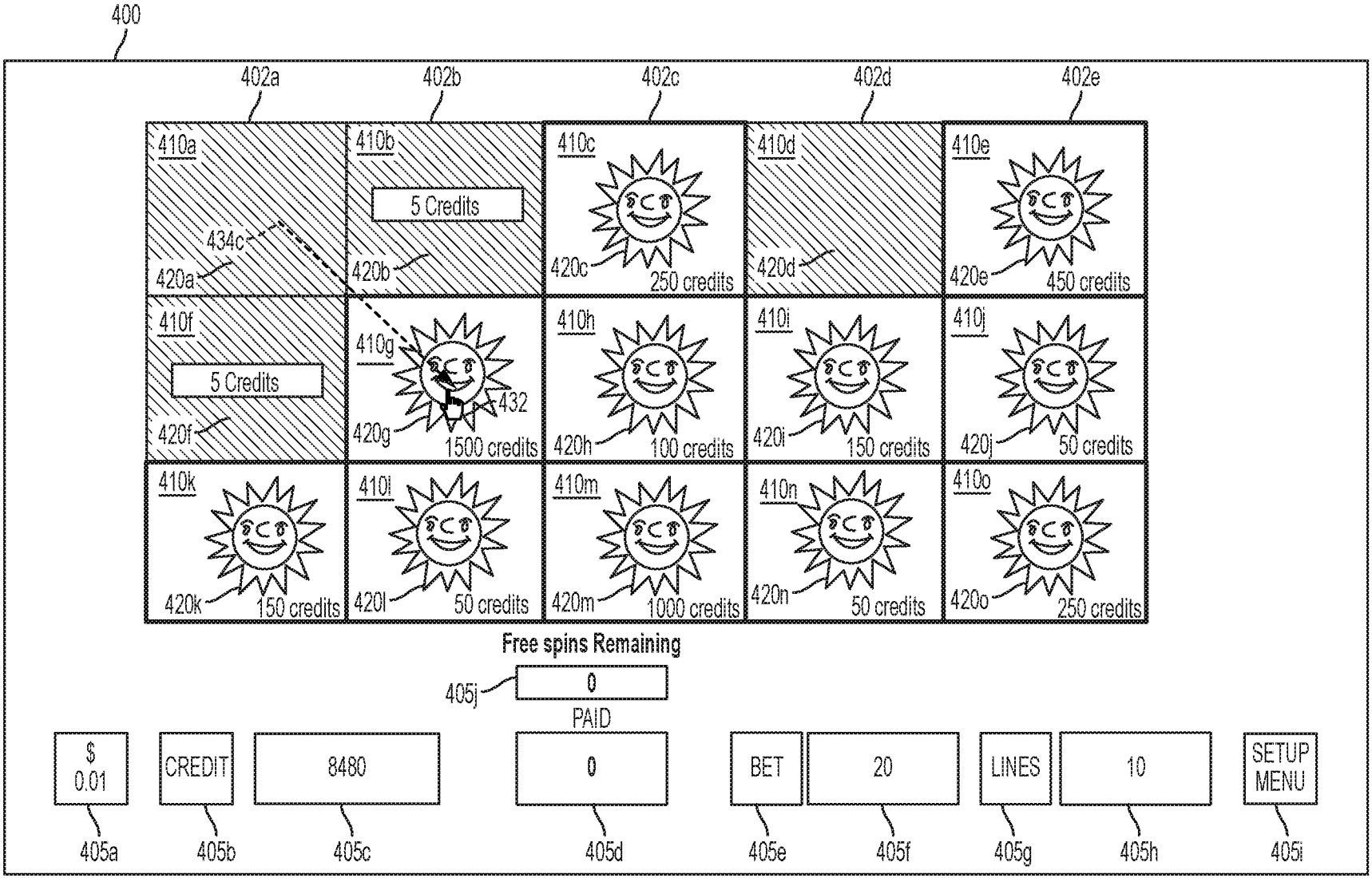

As illustrated in FIG. 4L, the player moved the Sun symbol in symbol display area 410*a* to symbol display area 410*g* with cursor 432. In some embodiments, the player may indicate the move to the gaming system using a touch screen interface. In some embodiments, the player may indicate the move to the gaming system using a mouse or some other human computer interface device. The gaming system assigned the 1500 credit value to the Sun symbol in symbol display area 410*g*. Accordingly, the player's move selection substantially increased the player's award in the bonus game.

Figure 4M:
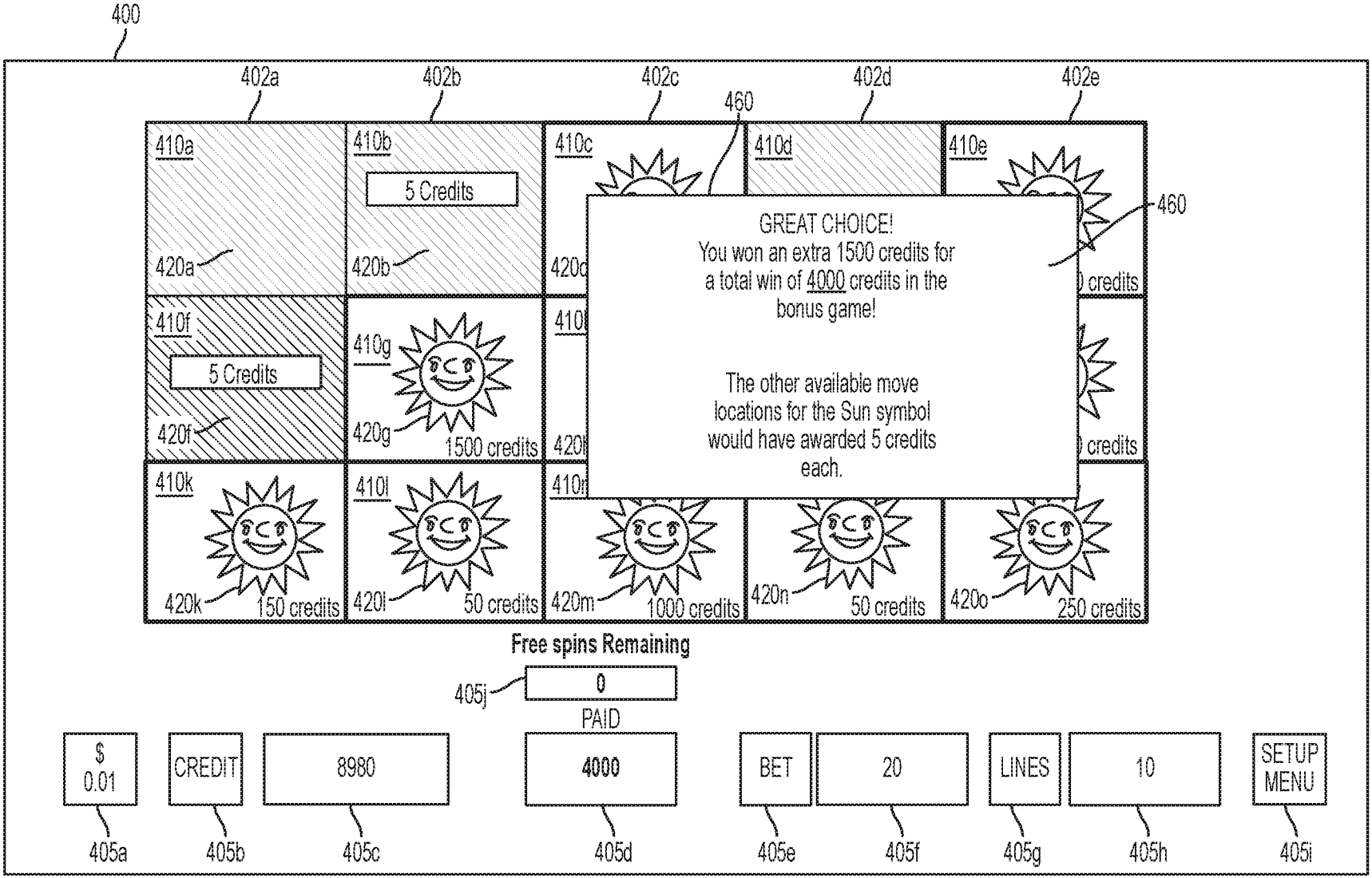

As illustrated in FIG. 4M, the gaming system displayed a message 460 to the player indicating that the player made a great move selection. The message may indicate that the player added an additional award value (e.g., 1500 credits) for a total bonus win of 4000 credits. The gaming system may alert the player that the other two available move selections would have provided low value awards, further enhancing the player's satisfaction with the game.

In the illustrated embodiment, no free spin games remain. Therefore, the gaming system does not generate additional symbols for symbol display areas in the bonus game. The play of the game ends. The player may continue to play additional games or cash out as discussed in connection with FIGS. 3A-3D.

While the embodiments discussed above illustrate the gaming system providing opportunities for the player or the gaming system to move Sun symbols to improve the player's award after no free spin games remain, it should be appreciated that the gaming system may enable the Sun symbol moves to occur at any time during the play of a game. For example, if the gaming system generated standalone Sun symbols as illustrated in FIG. 4D, the gaming system may enable the standalone Sun symbols to be moved at any suitable time during the play of the game (e.g., including before all of the free spins are used).

As noted above, the gaming system provides opportunities for the player or the gaming system to move Sun symbols in exchange for a wager or without a wager for an attempt to improve a player's award. In some embodiments where the gaming system provides opportunities for the player or the gaming system to move Sun symbols without a wager, the gaming system may use a variety of different triggering events to determine when the gaming system offers a player the ability to move Sun symbols to improve the player's award. In one embodiment, the gaming system periodically randomly determines whether to award a player one or more moves of Sun symbols. In some embodiments, the gaming system may associate one or more moves of Sun symbols with a threshold wager amount to play a game. For example, if the player places a maximum wager to play a game and the maximum wager is the threshold wager amount, the gaming system may offer the player one or more moves of Sun symbols. The threshold wager amount can be any suitable wager amount. In some embodiments, different wager amounts to play the game may be associated with different quantity of moves of Sun symbols. For example, a first wager amount to play the game may be associated with the gaming system providing the player with a first quantity of moves of Sun symbols. Whereas, a second wager amount to play the game may be associated with the gaming system providing the player with a second quantity of moves of Sun symbols. In some embodiments, the gaming system tracks the value of a player's wager over time and if the player has placed wagers totaling a predetermined threshold amount, the gaming system may offer the player one or more moves of Sun symbols when the player has reached or exceeded the predetermined threshold amount.

FIG. 5 illustrates a screen shot of one embodiment of a pay table 500 for a base game of the gaming system. Tables 502, 504, 506, 508, 510, 512, 514, and 516 are merely example payout awards for example symbol combinations. As noted above, it should be appreciated that the pay table is merely illustrative, and the symbols, awards, and the credit values may all be modified in any suitable manner.

FIG. 6 illustrates a screen shot of one embodiment of a pay table for a bonus game of the gaming system. As noted above, it should be appreciated that the pay table is merely illustrative, and the symbols, awards, and the credit values may all be modified in any suitable manner.

In various embodiments, other types of games may be improved with the game element movement. In one such embodiment, a gaming system may include a wheel (as opposed to a slot reel) that is evenly divided into a plurality of sections (e.g., like slices of a pie) with a win selector. Each wheel section is associated with an award value. When the player activates the wheel, the gaming system spins the wheel and randomly determines which section of the wheel will align with the win selector for a player's award. The gaming system awards the player the value associated with the wheel section that stops and aligns with the win selector when the wheel stops moving. If the player purchased a move, the gaming system with the wheel enables the player move or rotate the wheel to improve the players award. For example, low value awards often surround high value awards in sections of the wheel. If the player is awarded a low award, but purchased a move, the gaming system with the wheel may enable the player to rotate the wheel (either to the left or right one or more sections) to improve the player's low award.

In another alternative embodiment, a gaming system offers a player selection game (either in a base or bonus game). If the player purchases a move for such a selection game, the gaming system may permit the player to undo a prior selection and make a new selection in the hopes of improving upon the player's award. In other embodiments, the gaming system may enable the player to purchase improvements other than game element movements. For example, the gaming system may enable the player to purchase an additional scatter symbol, which may trigger entry into a bonus game or an award. The gaming system may also enable the player to purchase other additional symbols. Other suitable game improvements are possible.

In some embodiments with free spins, the gaming system may award additional free spins when certain conditions occur with persistent symbols. For example, on any free spin of the game, if a predetermined quantity of persistent symbols are generated and displayed, the gaming system may award three additional free spins to the player's free spins balance. Any suitable quantity of additional free spins can be added. The predetermined quantity of generated persistent symbols may also be assigned any suitable number, such as three or four persistent symbols during a spin of a play of the game. In some embodiments, the gaming system awards a jackpot award if the player obtains persistent symbols in every displayed symbol display area. In some embodiments, the jackpot is funded by portions of every play of a game. However, the jackpot can be funded in any suitable manner.

In one alternative embodiment, the gaming system may move one or more standalone persistent symbols to different symbol display areas during a play of the game, rather than holding every displayed persistent symbol in a fixed symbol display area, as was illustrated in FIGS. 4D-4M. In one embodiment of a free spin bonus game, the gaming system may move one or more standalone persistent symbols to different symbol display areas (e.g., during free spins of the bonus game) until the one or more standalone persistent symbols is adjacent to at least one other persistent symbol or the gaming system moves the one or more standalone persistent symbols off of the visible symbol display areas during the play of the game. In some embodiments, when the one or more standalone persistent symbols are removed from the display or moved off of the visible symbol display areas, such standalone persistent symbols can no longer provide additional awards to the player.

FIGS. 7A-7D illustrates one such alternative embodiment where the gaming system may move one or more standalone persistent symbols to different symbol display areas during a play of the game. In some embodiments, FIGS. 7A-7D illustrate a bonus game that is similar to the bonus game discussed in connection with FIGS. 4D-4M. Thus, the discussion of FIGS. 7A-7D focus on the differences from FIGS. 4D-4M and may remain silent with regard to similarities to FIGS. 4D-4M for the sake of brevity.

Figure 7A:
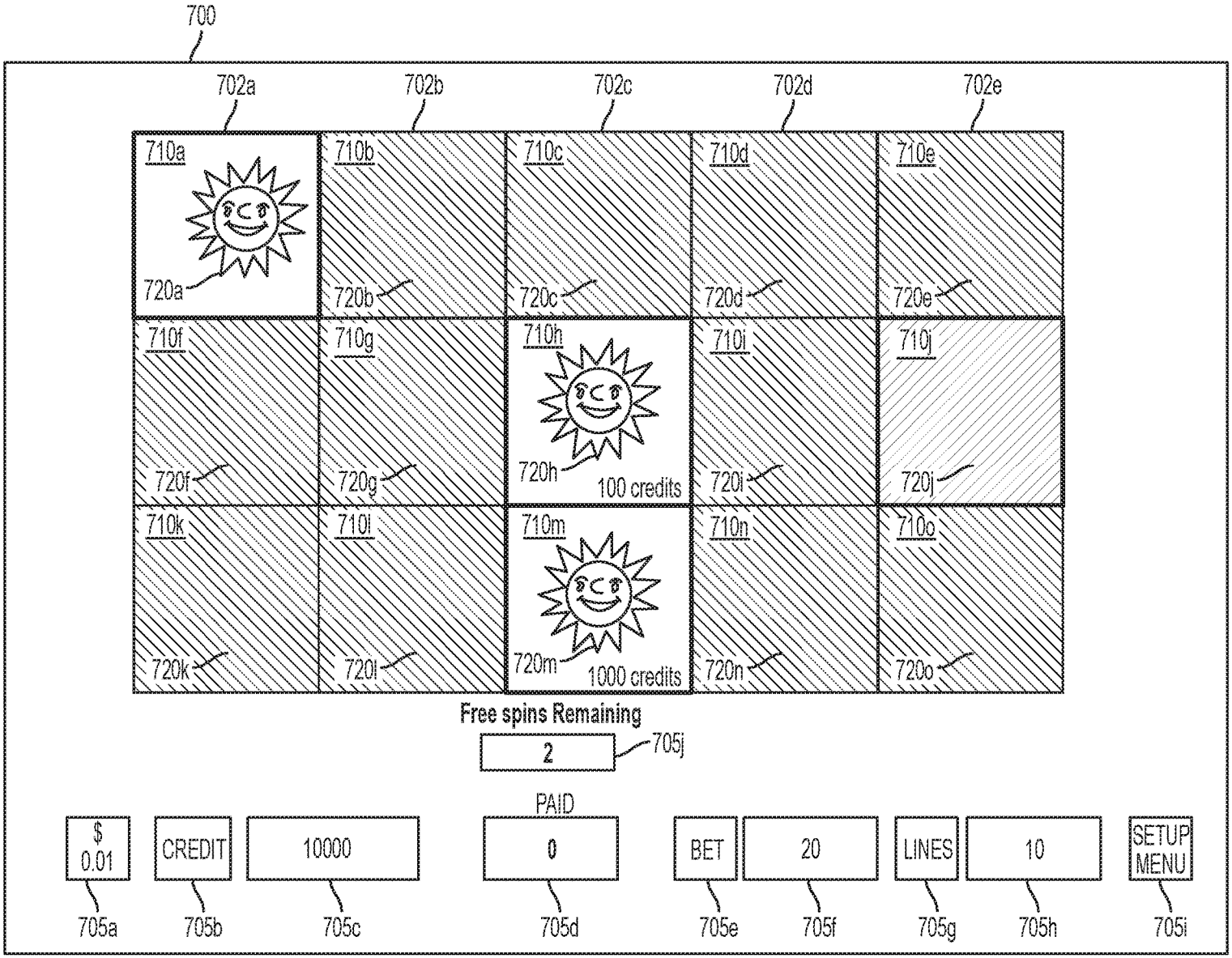
FIGS. 7A, 7B, 7C, and 7D illustrate screen shots of one alternative embodiment of a gaming system having improvements to game outcomes.

As illustrated in FIG. 7A, the gaming system randomly generated symbols 720*a*-720*o* from the sets of symbols associated with reels 702*a*-702*e*, respectively as part of a bonus game. As noted above, the gaming system may rely on random symbol generation performed by a pseudo RNG, a true RNG, or hardware RNG to generate the symbols for the bonus game. In one embodiment, the gaming system may also update the player's free spin balance meter (information area 705*j*) to reflect the player's available free spin balance.

The gaming system displays the generated symbols 720*a*-720*o* in symbol display areas 710*a*-701*o* as illustrated in FIG. 7A. Symbols 720*a*-720*o* displayed on reels 702*a*-702*e* illustrate the randomly generated symbols after the reels have stopped spinning. As illustrated in FIG. 7D, the gaming system randomly generated and displayed symbols 720*a*, 720*f*, and 720*k* in symbol display areas 710*a*, 710*f*, and 710*k* for reel 702*a*. The gaming system also randomly generated and displayed symbols 720*b*, 720*g*, and 720*l* in symbol display areas 710*b*, 710*g*, and 710*l* for reel 702*b*; symbols 720*c*, 720*h*, and 720*m* in symbol display areas 710*c*, 710*h*, and 710*m* for reel 702*c*; symbols 720*d*, 720*i*, and 720*n* in symbol display area 710*d*, 710*i*, and 710*n* for reel 702*d*; symbols 720*e*, 720*j*, and 720*o* in symbol display area 710*e*, 710*j*, and 710*o* for reel 702*e*. For purposes of illustration, symbols 720*b*-720*g*, 720*i*, 720*j*, 720*k*, 720*l*, 720*n*, and 720*o* are obscured from view because these symbols were not Sun symbols. In some embodiments, the symbols 720*b*-720*g*, 720*i*, 720*j*, 720*k*, 720*l*, 720*n*, and 720*o* may be partially visible or completely visible.

As illustrated in FIG. 7A, the gaming system generated and displayed Sun symbols (720*a*, 720*h*, and 720*m*) in symbol display areas 710*a*, 710*h*, and 710*m* in the game display 700. It should be appreciated that the displayed symbol combinations are merely for explanatory purposes and the gaming system may randomly generate any suitable combination of symbols based on defined symbol sets associated with their respective reels. In one embodiment, as illustrated in the pay table of FIG. 6, the Sun symbols were designated as pay symbols when meeting certain conditions. In this embodiment, the Sun symbols are also persistent symbols or freeze symbols, which generally remain in the symbol display area during a bonus game once generated and displayed during a free spin of the bonus game when also displayed substantially adjacent to at one other Sun symbol. In some embodiments, one or more generated standalone Sun symbols (e.g., Sun symbol 720*a*) may move one or more symbol display areas (e.g., move to symbol display areas 710*b*, 710*c*, 710*g*, 710*f*, etc.) for each free spin of the bonus game. In some embodiments, the gaming system may move at least one generated standalone Sun symbol until such standalone Sun symbol is adjacent to at least one other Sun symbol or the gaming system has moved the standalone Sun symbol off of the visible symbol display areas of screen 700.

FIG. 7A illustrates that Sun symbol 720*a* does not show an associated value. In this embodiment, Sun symbols that are not part of a contiguous group of Sun symbols are not shown with their associated value. In the embodiment discussed in FIGS. 7A-7D, the gaming system randomly generated and associated values from table 607 with each Sun symbol when such Sun symbol is generated for display. The gaming system shows the assigned values for generated and displayed Sun symbols when the Sun symbols are displayed as part of a contiguous group of Sun symbols. As illustrated in FIG. 7A, Sun symbol 720*h* and Sun symbol 720*m* are part of contiguous group of Sun symbols (they are each connected to another Sun symbol/directly adjacent to another Sun symbol in an adjacent symbol display area). Thus, Sun symbol 720*h* shows an assigned the value of 100 credits and Sun symbol 720*m* shows an assigned the value of 1000 credits (e.g., values randomly associated with the respective symbol display areas from table 607). As noted above, once a Sun symbol is generated and displayed during a bonus game and is adjacent to at least one other Sun symbol, such Sun symbols will remain displayed for the remainder of the bonus game. As such, Sun symbols 720*h* and 720*m* are persistently displayed on display device 700 through each remaining free spin of the bonus game and do not move. In some embodiments, Sun symbol 720*a* moves to different symbol display areas, but is also persistently displayed in one of the symbol display areas on display device 700 until the gaming system moves Sun symbol 720*a* to be adjacent to at least one other Sun symbol or the gaming system moves the Sun symbol 720*a* off of the symbol display areas of display device 700. In subsequent free spins of the bonus game, the player hopes that the gaming system will generate additional Sun symbols that are connected to already displayed Sun symbols 720*a*, 720*h*, 720*j*, and 720*m* to improve the player's bonus award. In some embodiments, the gaming system may execute an evaluation of the generated symbols on reels 702*a*-702*e* for winning symbol combinations (e.g., connected Sun symbols) and update information area 705*d* after each free spin. In other embodiments, as is illustrated in FIGS. 7A-7D, the gaming system may wait until all free spins have been exhausted before updating information area 705*d* with the player's award for the bonus game.

Figure 7B:
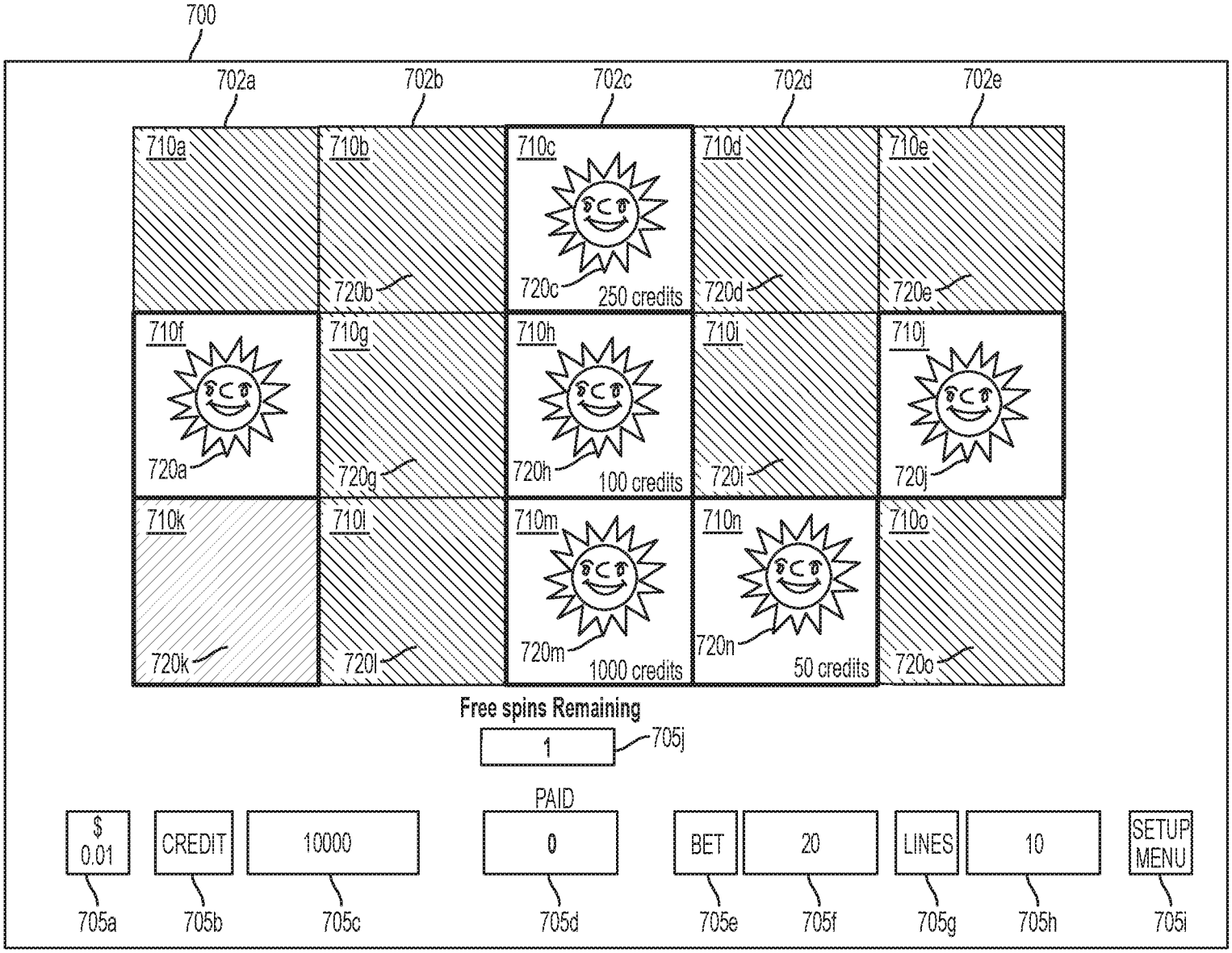

Turning to FIG. 7B, the gaming system executes another free spin of the bonus game. The gaming system updated free spin balance meter 705*j* to show the player that one free spins remain in the bonus game. Persistent Sun symbols 720*a*, 720*h*, and 720*m* remain displayed through the new free spin of the bonus round. However, as noted above, the gaming system moved Sun symbol 720*a* down one symbol display area on reel 702*a* to symbol display area 710*f*. In some embodiments, the gaming system moves the standalone Sun symbol in a vertical direction down one symbol display area for each free spin of the bonus game. In some embodiments, the gaming system stops moving the standalone Sun symbol once the standalone Sun symbol reaches the bottom of a reel. In other embodiments, the gaming system removes the standalone Sun symbol from the display in the next free spin after the standalone Sun symbol reaches the bottom symbol display area of a reel (e.g., once the standalone Sun symbol reaches symbol display area 710*k* of reel 702*a*, the gaming system may remove the standalone Sun symbol in the next free spin). As noted above, in some embodiments, the gaming system may also stop moving the standalone Sun symbol if the standalone Sun symbol is substantially adjacent (in an adjacent symbol display area) to at least one other Sun symbol. For example, if the gaming system generated another Sun symbol in symbol display area 710*g*, the gaming system would not move Sun symbol 720*a* for the next free spin.

It should be appreciated that the gaming system may move a standalone Sun symbol in any suitable direction and any suitable number of symbol display areas. For example, the gaming system could have moved the Sun symbol 720*a* over horizontally to symbol display area 710*b* or diagonally to symbol display area 710*g*. In some embodiments the gaming system can move the Sun symbol vertically upwards too. In some embodiments, the gaming system can move the standalone Sun symbol more than one symbol display area at a time (e.g., the gaming system may move Sun symbol 720*a* to symbol display area 710*k* or 710*c* after the first free spin).

In some embodiments, the gaming system randomly generates where (e.g., to which symbol display area) a standalone Sun symbol will move. In other embodiments, the gaming system determines where a standalone Sun symbol will move based on a predetermined movement path. For purposes of illustration, the gaming system illustrated in FIG. 7A-7D moves standalone Sun symbols on a predetermined movement path that is vertically downward along a reel.

As illustrated in FIG. 7B, the gaming system randomly generated symbols 720*a*-720*o* from the sets of symbols associated with reels 702*a*-702*e*, respectively. The gaming system may also update the player's free spin balance meter (information area 705*j*) to reflect the player's available free spin balance.

The gaming system displays the generated symbols 720*a*-720*o* in symbol display areas 710*a*-7010 as illustrated in FIG. 7B. Symbols 720*a*-720*o* displayed on reels 702*a*-702*e* illustrate the randomly generated symbols after the reels have stopped spinning. As illustrated in FIG. 7B, the gaming system randomly generated and displayed symbols 720*a*, 720*f*, and 720*k* in symbol display areas 710*a*, 710*f*, and 710*k* for reel 702*a*. The gaming system also randomly generated and displayed symbols 720*b*, 720*g*, and 720*l* in symbol display areas 710*b*, 710*g*, and 710*l* for reel 702*b*; symbols 720*c*, 720*h*, and 720*m* in symbol display areas 710*c*, 710*h*, and 710*m* for reel 702*c*; symbols 720*d*, 720*i*, and 720*n* in symbol display area 710*d*, 710*i*, and 710*n* for reel 702*d*; symbols 720*e*, 720*j*, and 720*o* in symbol display area 710*e*, 710*j*, and 710*o* for reel 702*e*. As noted above, for purposes of illustration, grayed out symbols are obscured from view because these symbols were not Sun symbols and accordingly did not provide a payout award according to the bonus pay table in FIG. 6.

As also illustrated in FIG. 7B, the gaming system generated and displayed new Sun symbols 720*c*, 720*j*, and 720*n* in symbol display areas 710*c*, 710*j*, and 710*n* that add to the previously generated Sun symbols 720*a*, 720*h*, and 720*m* in symbol display areas 710*a*, 710*h*, and 710*m* in the game display 700. FIG. 7B further illustrates that Sun symbols 720*a* and 720*j* do not show associated values because these Sun symbols are not part of a contiguous group of Sun symbols. However, as illustrated in FIG. 7B, Sun symbol 720*c*, 720*h*, 720*m*, and 720*n* are all part of a contiguous group of Sun symbols (they are each connected to another Sun symbol/directly or substantially adjacent to another Sun symbol in an adjacent symbol display area). Thus, Sun symbols 720*c*, 720*h*, 720*m*, and 720*n* are respectively assigned the values 250, 100, 1000, and 50 credits. Sun symbols, 720*c*, 720*h*, 720*m*, and 720*n* are persistently displayed on display device 700 through each remaining free spin of the bonus game. In subsequent free spins, the player hopes that the gaming system will generate additional Sun symbols that are connected to already displayed Sun symbols 720*a*, 720*c*, 720*h*, 720*j*, 720*k*, 720*m*, and 720*n* to improve the player's award. In some embodiments, because Sun symbol 720*j* is a standalone Sun symbol, the gaming system may move such Sun symbol down one symbol display area for the next free spin. However, in some embodiments, one or more standalone Sun symbols may be fully persistent and not move symbol display areas between free spins.

In some embodiments, the gaming system evaluates all symbols generated and displayed for this free spin illustrated in FIG. 7B. However, in some embodiments, the gaming system skips evaluating symbols that are not Sun symbols.

Figure 7C:
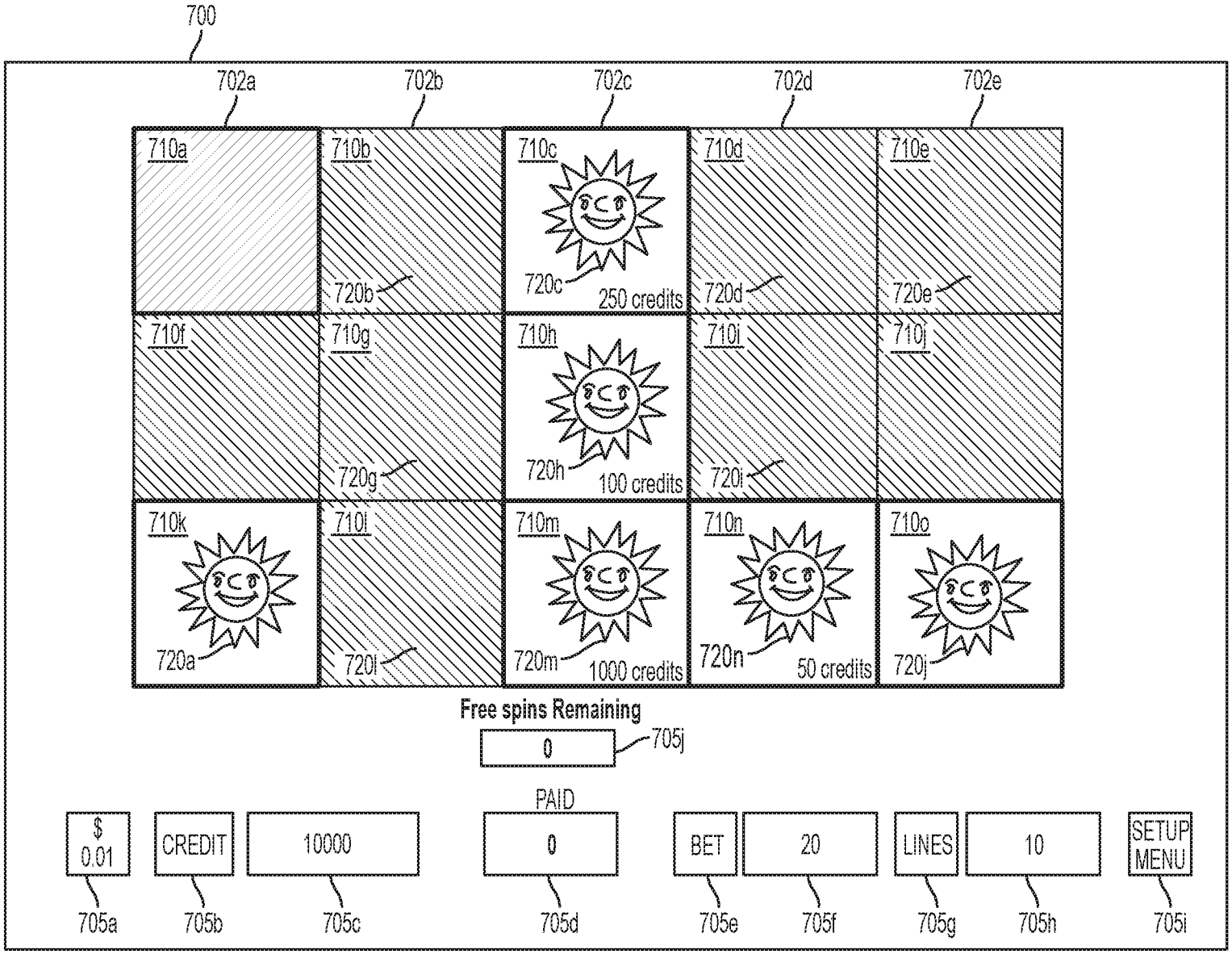
Figure 7D:
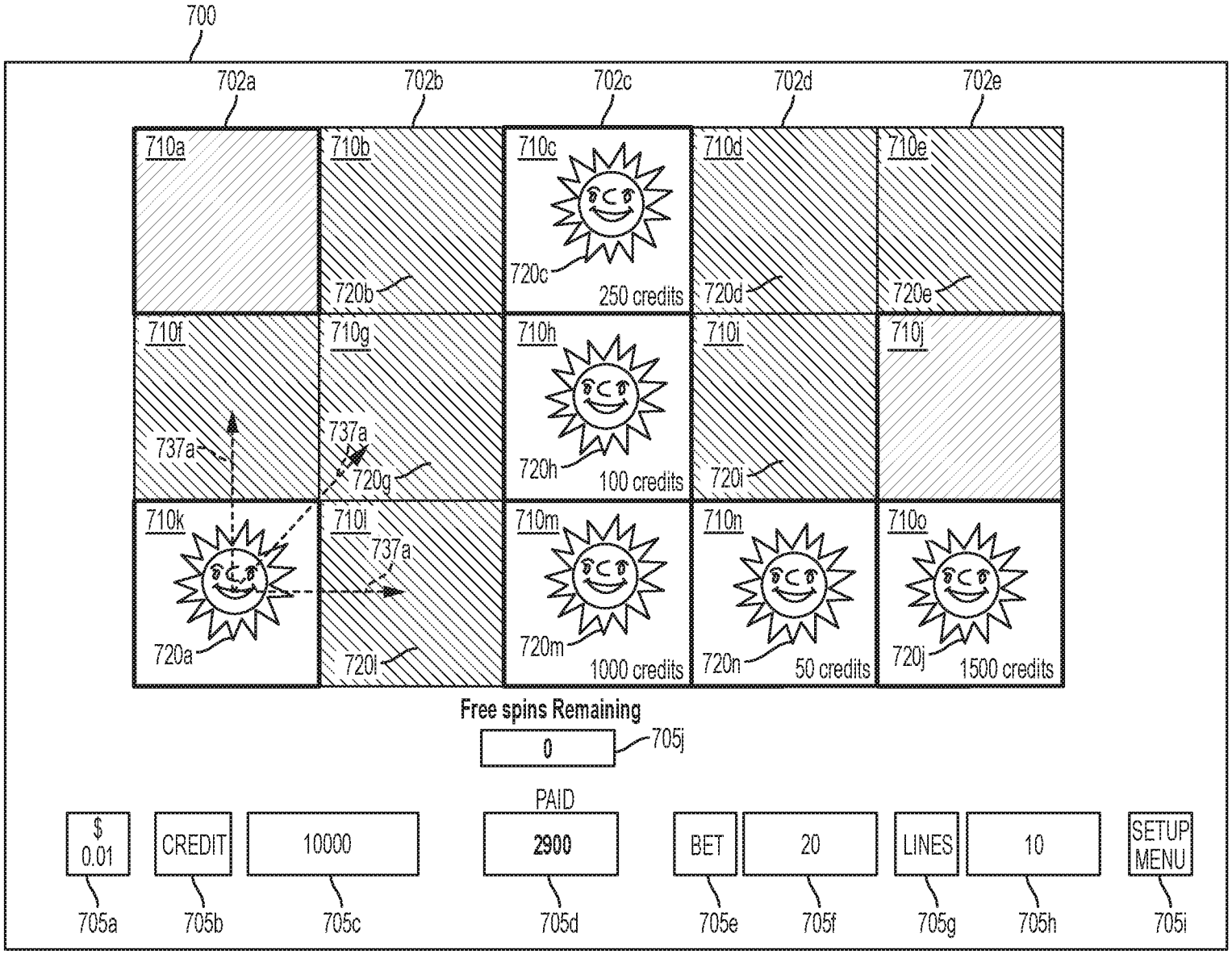

Turning to FIG. 7C, the gaming system executed another free spin of the bonus game. The gaming system updated the free spin balance meter 705*j* to show the player that zero free spins remain in the bonus game. The gaming system moved each of the standalone Sun symbols 720*a* and 720*j* down one symbol display area on each of their respective reels. FIG. 7C illustrates that the gaming system moved standalone Sun symbol 702*a* to symbol display area 710*k* and Sun symbol 720*j* to symbol display area 710*o*. In this embodiment, the gaming system did not generate additional new Sun symbols. However, by moving standalone Sun symbols 720*a* and 720*j*, the gaming system made Sun symbol 720*j* adjacent to at least one other Sun symbol 720*n*. As illustrated in FIG. 7D, the gaming system revealed that Sun symbol 720*j* provides an additional 1500 credit award to the player because it became adjacent to at least one other Sun symbol.

As illustrated in FIGS. 7C and 7D, the standalone Sun symbol 720*a* did not become adjacent to another Sun symbol. In some embodiments, if additional free spins remained, the gaming system may remove standalone Sun symbol 720*a* for a next free spin of the bonus round and therefore remove the opportunity for the player to win a credit award associated with Sun symbol 720*a*.

Returning to FIG. 7D, in some embodiments, the gaming system provides the player the ability to move or to purchase the ability to move Sun symbol 720*a* to an adjacent symbol display area without an existing Sun symbol (e.g., symbol display areas 710*f*, 710*g*, or 710*l*). Some of the possible movement directions are shown with directional arrows 737*a*. In some embodiments, the gaming system may automatically move Sun symbol 720*a*. This process is similar to the process described in FIGS. 4J-4M and thus will not be repeated again for the sake of brevity.

Thus, it should be appreciated that in some embodiments, the gaming system does not hold some standalone persistent symbols in a single symbol display area unless such standalone persistent symbols is or becomes adjacent to at least one other persistent symbol.

Based on the forgoing description, it should be appreciated that a gaming system and method with improvements to game outcomes creates new and very exciting ways for a player to obtain improved winnings with a potential to earn frequent and greater awards or to turn some portions of a losing outcome into a winning outcome. Such a potential to earn greater awards creates a greatly improved sense of anticipation for players.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

We claim:

1. A gaming system comprising:

a processor;

a display device;

an input device;

a value acceptor;

a value dispenser; and a memory device that stores instructions that, when executed by the processor, cause the processor to:

establish a credit balance based at least in part on a monetary value received by the value acceptor;

place a wager following receipt of a wager input via the input device, the credit balance being decreased by the wager;

randomly generate a first plurality of symbols;

display, on the display device, the first plurality of symbols in a plurality of symbol display areas, each of the first plurality of symbols being associated with a separate one of the plurality of symbol display areas;

determine if any persistent symbols were generated in the first plurality of symbols;

randomly generate a second plurality of symbols for the plurality of symbol display areas, each of the second plurality of symbols being associated with a separate one of the plurality of symbol display areas;

display, on the display device, a subset of the second plurality of symbols, where the second plurality of symbols replaces the displayed first plurality of symbols in the associated symbol display areas without replacing any displayed persistent symbols from the first plurality of symbols in the associated symbol display areas;

determine if any displayed persistent symbol is not adjacent to at least one other displayed persistent symbol;

receive at least one move request if any displayed persistent symbol is not adjacent to at least one other displayed persistent symbol;

move a first displayed persistent symbol to be adjacent to a second displayed persistent symbol; and issue value from the value dispenser based on the credit balance upon receipt of a cash out signal.

2. The gaming system of claim 1, wherein the second plurality of symbols comprise at least one persistent symbol.

3. The gaming system of claim 2, wherein any displayed persistent symbols from the first plurality of symbols and the second plurality of symbols remain displayed after generating and displaying a subset of a third plurality of symbols.

4. The gaming system of claim 1, wherein the processor further receives a plurality of move requests.

5. The gaming system of claim 4, wherein the plurality of move requests cause the processor to move the first displayed persistent symbol across at least two of the symbol display areas.

6. The gaming system of claim 4, wherein a first of the plurality of move requests cause the processor to move the first displayed persistent symbol and a second of the plurality of move request cause the processor to move the second displayed persistent symbol.

7. The gaming system of claim 1, wherein the first plurality of symbols and the second plurality of symbols are displayed on a plurality of reels, wherein moving the first displayed persistent symbol to be adjacent to the second displayed persistent symbol comprises moving the first displayed persistent symbol in a vertical direction along a first reel of the plurality of reels.

8. The gaming system of claim 1, wherein the first plurality of symbols and the second plurality of symbols are displayed on a plurality of reels;

wherein the first displayed persistent symbol is displayed on a first reel of the plurality of reels, the second displayed persistent symbol is displayed on a second reel of the plurality of reels; and wherein moving the first displayed persistent symbol to be adjacent to the second displayed persistent symbol comprises moving the first displayed persistent symbol in a horizontal or diagonal direction from the first reel to the second reel.

9. The gaming system of claim 1, wherein a cost of the at least one move request varies based on the direction the first displayed persistent symbol is moved; and the credit balance is decreased by the cost of the at least one move request.

10. The gaming system of claim 1, wherein the first displayed persistent symbol can be moved to be adjacent to a plurality of different displayed persistent symbols.

11. The gaming system of claim 10, wherein a cost of the at least one move request varies based on a potential award that can be obtained by moving the first displayed persistent symbol; and the credit balance is decreased by the cost of the at least one move request.

12. The gaming system of claim 10, wherein before receiving the at least one move request, the processor displays the potential award that can be obtained for purchasing the at least one move request.

13. The gaming system of claim 1, wherein the at least one move request is received before the first plurality of symbols are generated and displayed.

14. The gaming system of claim 1, wherein the at least one move request is received after the second plurality of symbols are generated and displayed.

15. The gaming system of claim 1, wherein a cost of the at least one move request is a first value if the at least one move request is purchased prior to when the first plurality of symbols are generated and the cost of the at least one move request is a second value if the at least one move request is purchased after the first plurality of symbols are generated.

16. The gaming system of claim 15, wherein the first value is lower than the second value.

17. The gaming system of claim 1, wherein the processor randomly generates and assigns a value to each of the plurality of symbol display areas.

18. The gaming system of claim 17, wherein the each displayed persistent symbol is assigned the value associated with the symbol display area where the displayed persistent symbol is displayed.

19. A method of operating a gaming system, the method comprising:

receiving, by a monetary value acceptor, a monetary value;

establishing, by a processor of the gaming system, a credit balance based at least in part on the received monetary value;

accepting, from an input device, a wager amount;

decreasing, by the processor, the credit balance by the wager amount;

randomly generating a first plurality of symbols;

displaying, on a display device, the first plurality of symbols in a plurality of symbol display areas, each of the first plurality of symbols being associated with a separate one of the plurality of symbol display areas;

determining if any persistent symbols were generated in the first plurality of symbols;

randomly generating a second plurality of symbols in the plurality of symbol display areas, each of the second plurality of symbols being associated with a separate one of the plurality of symbol display areas;

displaying, on the display device, a subset of the second plurality of symbols, where the second plurality of symbols replaces the displayed first plurality of symbols in the associated symbol display areas without replacing any displayed persistent symbols from the first plurality of symbols in the associated symbol display areas;

determining if any displayed persistent symbol is not adjacent to at least one other displayed persistent symbol;

receiving at least one move request if any displayed persistent symbol is not adjacent to at least one other displayed persistent symbol;

moving a first displayed persistent symbol to be adjacent to a second displayed persistent symbol; and issuing another monetary value, by a value dispenser, based on the credit balance upon receipt of a cash out signal.

20. A gaming system comprising:

a cabinet;

a processor;

a display device;

an input device;

a value acceptor;

a value dispenser; and a memory device that stores instructions that, when executed by the processor, cause the processor to:

establish a credit balance based at least in part on a monetary value received by the value acceptor;

place a wager following receipt of a wager input via the input device, the credit balance being decreased by the wager;

randomly generate a first plurality of symbols;

display, on the display device, the first plurality of symbols in a plurality of symbol display areas, each of the first plurality of symbols being associated with a separate one of the plurality of symbol display areas;

determine if any persistent symbols were generated in the first plurality of symbols;

randomly generate a second plurality of symbols for the plurality of symbol display areas, each of the second plurality of symbols being associated with a separate one of the plurality of symbol display areas;

display, on the display device, a subset of the second plurality of symbols, where the second plurality of symbols replaces the displayed first plurality of symbols in the associated symbol display areas without replacing any displayed persistent symbols from the first plurality of symbols in the associated symbol display areas;

determine if any displayed persistent symbol is not adjacent to at least one other displayed persistent symbol;

receive at least one move instruction if any displayed persistent symbol is not adjacent to at least one other displayed persistent symbol;

move a first displayed persistent symbol to be adjacent to a second displayed persistent symbol in accordance with the at least one move instruction;

and issue value from the value dispenser based on the credit balance upon receipt of a cash out signal.

* * * * *